US007347538B2

(12) United States Patent
Mita

(10) Patent No.: US 7,347,538 B2
(45) Date of Patent: Mar. 25, 2008

(54) METHOD FOR MANUFACTURING DISCHARGE HEAD, AND DISCHARGE HEAD

(75) Inventor: Tsuyoshi Mita, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 346 days.

(21) Appl. No.: 11/085,220

(22) Filed: Mar. 22, 2005

(65) Prior Publication Data

US 2005/0212865 A1 Sep. 29, 2005

(30) Foreign Application Priority Data

Mar. 23, 2004 (JP) ..... 2004-085274

(51) Int. Cl.
*B41J 2/045* (2006.01)

(52) U.S. Cl. ..... 347/68; 347/71; 29/890.1

(58) Field of Classification Search ..... 347/70–72, 347/68, 63, 65, 67; 29/611, 890.1
See application file for complete search history.

(56) References Cited

U.S. PATENT DOCUMENTS 6,561,634 B1 * 5/2003 Nishikawa ..... 347/71
2002/0189099 A1 12/2002 Nishikawa

FOREIGN PATENT DOCUMENTS

JM 2003-136714 A 5/2003
JP 5-170555 A 7/1993
JP 10-128976 A 5/1998
JP 2000-79686 A 3/2000
JP 2003-136715 A 5/2003

* cited by examiner

*Primary Examiner*—Juanita D. Stephens
(74) *Attorney, Agent, or Firm*—Birch, Stewart, Kolasch & Birch, LLP

(57) ABSTRACT

The method for manufacturing a discharge head having a piezoelectric body which applies a discharge pressure to a droplet of liquid discharged onto a discharge receiving medium, the method comprises: a piezoelectric film forming step of forming a film of a piezoelectric body onto at least one surface of a base substrate, by means of a thin film forming technique; a heat treatment step of sintering the piezoelectric film by heat treatment, at least one of during formation of the piezoelectric film in the piezoelectric film forming step, and after formation of the piezoelectric film; a diaphragm forming step of forming a diaphragm by at least one of bonding and film deposition onto a surface of the piezoelectric body on an opposite side to the base substrate, after the piezoelectric body has been formed by the piezoelectric film forming step and the heat treatment step; a pressure chamber forming step of forming pressure chamber walls on a surface of the diaphragm on an opposite side to the piezoelectric body; a discharge hole plate bonding step of bonding a discharge hole plate formed with discharge holes which discharge the liquid held in pressure chambers, onto the pressure chamber walls; and a base substrate removing step of removing at least a portion of the base substrate, wherein a ratio b/a between a coefficient of thermal expansion, a, of the base substrate and a coefficient of thermal expansion, b, of the piezoelectric body is within a prescribed range.

17 Claims, 19 Drawing Sheets

FIG.11

| HEAT TREATMENT TEMPERATURE T | DIFFERENTIAL K, BETWEEN COEFFICIENTS OF THERMAL EXPANSION | WARPING / PEELING APART | BONDING RESULT |
|---|---|---|---|
| 600°C | 40% | PEELING | POOR |
| 200°C | 40% | WARPING | FAIR |
| 600°C | 30% | WARPING WITHIN ALLOWABLE RANGE | GOOD |
| 600°C | 4% | NO WARPING | GOOD |

FIG.12

| T (HEAT TREATMENT TEMPERATURE) | Tc (ROOM TEMPERATURE) | $b \times 10^{-6}$ COEFFICIENT OF THERMAL EXPANSION OF PZT | $a \times 10^{-6}$ COEFFICIENT OF THERMAL EXPANSION OF BASE SUBSTRATE | $c \times 10^{-3}$ $(c=(T-Tc) \times \lvert a-b \rvert)$ | WARPING |
|---|---|---|---|---|---|
| 600 | 20 | 10 | 14 | 2.32 | NO |
| 200 | 20 | 10 | 14 | 0.72 | NO |
| 600 | 20 | 10 | 6.0 | 2.32 | NO |
| 600 | 20 | 5.0 | 7.0 | 1.16 | NO |
| 1000 | 20 | 1.0 | 1.4 | 0.39 | NO |
| 200 | 20 | 1.0 | 1.4 | 0.072 | NO |
| 600 | 20 | 1.0 | 1.4 | 0.23 | NO |
| 1000 | 20 | 12 | 1.68 | 4.70 | NO |
| 1100 | 20 | 12 | 1.68 | 5.18 | YES |

$$\Delta l = \frac{\Delta t \times \alpha \times l}{2}$$

METHOD FOR MANUFACTURING DISCHARGE HEAD, AND DISCHARGE HEAD

BACKGROUND OF THE INVENTION

1. Field of the Invention

The present invention relates to a method for manufacturing a discharge head, and a discharge head, and more particularly, to a method for manufacturing a discharge head having a thin film laminate structure, and a structure for same.

2. Description of the Related Art

In recent years, inkjet printers have come to be used widely as data output apparatuses for outputting images, documents, or the like. By driving recording elements, such as nozzles, provided in a recording head in accordance with data, an inkjet printer is able to form data onto a recording medium, such as recording paper, by means of ink discharged from the nozzles.

In an inkjet printer, a desired image is formed on a recording medium by causing a recording head having a plurality of nozzles and a recording medium to move relative to each other, while causing ink droplets to be discharged from the nozzles.

The print quality of the image output by the inkjet recording apparatus depends largely on the performance of the print head mounted in the apparatus. In other words, in order to improve print quality in the output image, it is necessary to improve the characteristics of the print head.

A print head installed in an inkjet recording apparatus may be a full line type print head which has a nozzle row of a length corresponding to the full width of the recording medium, or a serial (shuttle scanning) type of print head which has a nozzle row of a length shorter than the width of the recording medium and which forms a line in the breadthways direction of the recording medium by scanning in this breadthways direction. In a full line type print head, it is possible to perform single-pass printing whereby an image is formed over the whole print region of the recording medium, by scanning the print head once of the recording medium. Therefore, high-speed printing is possible, in comparison with a serial type head.

In order to improve image quality, it is necessary to form very fine dots at high density on the recording medium. This means positioning nozzles having very fine hole diameter at high density in the print head, and ultra-fine processing technology having good processing accuracy is used to form the nozzles and pressure chambers (ink chambers) in the print head.

However, in a long print head, such as a full line print head as described above, warping of the head structure is liable to occur. In particular, warping is more liable to occur in the lengthwise direction, compared to the breadthways direction, and if warping occurs in a print head, then this has a significant effect on printing performance.

For example, if the print head suffers warp in the lengthwise direction, then the clearance between the surface of the print head on which the nozzles are formed (the surface of the print head opposing the recording medium) and the recording medium may vary between the central region of the head and the respective end regions of the head, and a large error may arise in the landing positions of the ink droplets ejected from the nozzles in the vicinity of the end regions of the head. Moreover, if one print head is provided for each respective color, in order to achieve color image printing, then any error in landing positions between the respective heads will cause color irregularities.

In this way, warping of the print head causes image blurring and color irregularities, and hence has a major impact on the quality of the images output by the inkjet printer.

In general, a print head installed in an inkjet printer, or the like, has a laminated structure in which a plurality of thin film (thin plate) members are layered together. If there is warping of the members forming the respective layers, then problems arise, such as bonding faults between the layers, and misalignment of connecting holes, openings, and the like, between layers. Therefore, it may become impossible to achieve the desired printing characteristics. Furthermore, in a laminated structure in which a plurality of thin film members are layered together, warping is liable to occur when the structure returns to normal temperature after heat treatment steps, due to differences in the thermal expansivity of the respective layers.

In order to resolve problems of this kind, processing methods and materials suited to these methods are selected for the members forming each layer, according to the processing accuracy required. On the other hand, printing characteristics are maintained in the print head by selecting materials that are not liable to warping (namely, materials having a low coefficient of thermal expansion), in order to prevent warping during heat treatment, and by devising the manufacturing process and the head structure in such a manner that even if the constituent members of the print head do warp, the warping is mutually cancelled out between the respective layers, and hence warping is cancelled out in the laminated structure as a whole.

In the liquid discharge head and method for manufacturing same described in Japanese Patent Application Publication No. 2003-136714, the diaphragm is made of a metallic oxide material, and the walls of the pressure chambers are made of a corrosion-resistant metal, thereby increasing the corrosion resistance of the pressure chambers.

Furthermore, in the discharge head and method for manufacturing same described in Japanese Patent Application Publication No. 2003-136715, the diaphragm is made of a piezoelectric material and the pressure chamber walls are made of a corrosion-resistant metal, in such a manner that the diaphragm is also used as a piezoelectric body.

However, in order to achieve high-precision ultra-fine processing, it is necessary to use a material suited to the processing method in each layer. This means using different materials in each of the layers constituting the laminated structure, and if these materials have different coefficients of thermal expansion, then warping will occur after heat treatment. Furthermore, materials that are not liable to warping are difficult to process, or require special processing technologies, and the difficulty of post-processing and the number of processing steps may increase.

In the discharge head and the method for manufacturing same described in Japanese Patent Application Publication Nos. 2003-136714 and 2003-136715, a corrosion-resistant metal is used as the material for the pressure chambers, and wet etching is used-to form the pressure chambers. For example, if stainless steel is used as the material for the pressure chambers, then it is difficult to form very fine shapes without curved edges or tapering, by controlling the etching liquid during wet etching. Moreover, taking account of the warping caused by heat generated when forming the piezoelectric film on the substrate (diaphragm plate) by aerosol deposition, it is necessary to form the substrate to a large thickness. This is disadvantageous in terms of processing accuracy when processing shapes of high aspect ratio in order to form pressure chambers in the substrate by etching.

SUMMARY OF THE INVENTION

The present invention has been contrived in view of the aforementioned circumstances, and an object thereof is to provide a discharge head and a method for manufacturing a discharge head, which prevents warping from occurring during the manufacture of a liquid discharge head, while also achieving ultra-fine processing of high accuracy.

In order to attain the aforementioned object, the present invention is directed to a method for manufacturing a discharge head having a piezoelectric body which applies a discharge pressure to a droplet of liquid discharged onto a discharge receiving medium, the method comprising: a piezoelectric film forming step of forming a film of a piezoelectric body onto at least one surface of a base substrate, by means of a thin film forming technique; a heat treatment step of sintering the piezoelectric film by heat treatment, at least one of during formation of the piezoelectric film in the piezoelectric film forming step, and after formation of the piezoelectric film; a diaphragm forming step of forming a diaphragm by at least one of bonding and film deposition onto a surface of the piezoelectric body on an opposite side to the base substrate, after the piezoelectric body has been formed by the piezoelectric film forming step and the heat treatment step; a pressure chamber forming step of forming pressure chamber walls on a surface of the diaphragm on an opposite side to the piezoelectric body; a discharge hole plate bonding step of bonding a discharge hole plate formed with discharge holes which discharge the liquid held in pressure chambers, onto the pressure chamber walls; and a base substrate removing step of removing at least a portion of the base substrate, wherein a ratio b/a between a coefficient of thermal expansion, a, of the base substrate and a coefficient of thermal expansion, b, of the piezoelectric body is within a prescribed range.

More specifically, a material having a coefficient of thermal expansion, a, which is near the coefficient of thermal expansion, b, of the piezoelectric body is used for the base substrate on which the piezoelectric body is formed, and heat treatment is carried out in order to heat and sinter the piezoelectric film, after the piezoelectric film has been formed on the base substrate and/or while the piezoelectric film is formed on the base substrate. Therefore, it is possible to reduce the warping of the base substrate and the piezoelectric body that occurs when they return to normal temperature after heat treatment.

Furthermore, since the steps of bonding or forming a diaphragm by film deposition, forming the pressure chamber walls, and bonding a discharge hole plate to the pressure chamber walls, are carried out after heat treatment has been performed, then no warping occurs in the pressure chamber wall plate or the discharge hole plate as a result of heat treatment.

The thin film forming technology may include a deposition method, such as aerosol deposition in which a thin film is formed by depositing particles of material onto a substrate, a spraying method, such as sputtering, in which a metal having a high melting-point is formed into electrodes, melted by electrical discharge, and molten particles of the metal are blown onto a plate receiving member at high-speed, thereby forming a covering on same, or a corrosive method, such as etching, in which a prescribed shape is obtained by removing patterned metal by means of a corrosive solution, or the like. Furthermore, apart from this, it is also possible to use another method, such as a sol gel method, a laser ablation method, MOCVD, vapor deposition, or the like.

The base substrate is a base substrate for forming the piezoelectric body, and when the diaphragm and the pressure chambers have been formed after forming the piezoelectric body, and when the discharge hole plate has been bonded, at least a portion of the base substrate is removed. The remaining portions of the base substrate increase the rigidity. Therefore, increased rigidity in the discharge head as a whole can be expected by restricting the removal of the base substrate to the minimum necessary regions. The base substrate removal step should be carried out after the heat treatment step, at the least.

The piezoelectric body may be a split electrode type piezoelectric body, in which one piezoelectric body is made to function equivalently to a plurality of piezoelectric bodies, by providing a plurality of individual electrodes on one piezoelectric body and controlling the individual electrodes independently, or a split mechanism type piezoelectric body in which at least one individual electrode is provided in each piezoelectric body and one piezoelectric body is driven by one drive signal. The present invention may be applied to either of these types of piezoelectric body.

Furthermore, it is also possible to use a piezoelectric ceramic, such as lead zirconate titanate, or barium titanate, as the material for the piezoelectric body.

The piezoelectric film forming step may include an individual electrode forming step which forms individual electrodes for applying a drive voltage.

The heat treatment step may include a mode where the piezoelectric film is heated after forming the piezoelectric film, or a mode where the piezoelectric film is formed in a heated gas atmosphere.

The discharge head may be a full line type discharge head in which discharge holes for discharging liquid droplets are arranged through a length corresponding to the entire width of the discharge receiving medium, or a serial type discharge head (shuttle scanning type discharge head) in which a short head having discharge holes for discharging liquid droplets arranged through a length that is shorter than the entire width of the discharge receiving medium discharges liquid droplets onto the discharge receiving medium while scanning in the breadthways direction of the discharge receiving medium.

A full line discharge head may be formed to a length corresponding to the full width of the recording medium by combining short heads having rows of discharge holes which do not reach a length corresponding to the full width of the discharge receiving medium, these short heads being joined together in a staggered matrix fashion.

Preferably, the ratio b/a between the coefficient of thermal expansion, a, of the base substrate and the coefficient of thermal expansion, b, of the piezoelectric body satisfies the following relationship: $0.6 \leqq (b/a) \leqq 1.4$.

More specifically, if the coefficient of thermal expansion a of the base substrate is within ±40% of the coefficient of thermal expansion b of the piezoelectric body, then it is possible to suppress warping occurring in the base substrate and the piezoelectric body when they return to normal temperature after a heat treatment step for sintering the piezoelectric film formed on the base substrate. Furthermore, desirably, a mode is adopted where $0.7 \leqq (b/a) \leqq 1.3$ (within ±30%).

Preferably, temperature T of the heat treatment step satisfies the following relationship: $T=(c/|a-b|)+Tc$, where Tc represents room temperature, a represents the coefficient of thermal expansion of the base substrate, b represents the coefficient of thermal expansion of the piezoelectric body, and c represents a difference in thermal change.

In other words, since the processing temperature T during the heat treatment process and the coefficient of thermal expansion a of the base substrate (the material of the base substrate) are determined in such a manner that the value of the difference in thermal change, c, between the base substrate and the piezoelectric body during heat treatment is within a prescribed range, then the difference in the amount of extension of the base substrate and the piezoelectric body during heat treatment is small, and hence the warping of the base substrate and the piezoelectric body can be reduced.

The difference in thermal change, c, indicates the difference (dimensionless) in the amount of extension per unit length l with respect to temperature change in a composite member including two members joined together. Desirably, the difference in thermal change, c, is as small as possible. The difference in thermal change, c, can be applied in the lengthwise direction, the breadthways direction and the thickness direction of the discharge head.

Preferably, the difference in thermal change, c, satisfies the following relationship: $c \leqq 5.0\times10^{-3}$.

More specifically, since the coefficient of thermal expansion a of the base substrate and the temperature T during heat treatment are determined in such a manner that the difference in thermal change, c, is equal to or less than $5.0\times10^{-3}$, then the difference in the amount of extension of the base substrate and the piezoelectric body during heat treatment is small, and hence warping of the base substrate and the piezoelectric body can be prevented.

In order to attain the aforementioned object, the present invention is also directed to a method for manufacturing a discharge head having a piezoelectric body which applies a discharge pressure to a droplet of liquid discharged onto a discharge receiving medium, the method comprising: a piezoelectric film forming step of forming a film of a piezoelectric body onto at least one surface of a base substrate, by means of a thin film forming technique; a heat treatment step of sintering the piezoelectric film by heat treatment, at least one of during formation of the piezoelectric film in the piezoelectric film forming step, and after formation of the piezoelectric film; a diaphragm forming step of forming a diaphragm by at least one of bonding and film deposition onto a surface of the piezoelectric body on an opposite side to the base substrate, after the piezoelectric body has been formed by the piezoelectric film forming step and the heat treatment step; a pressure chamber forming step of forming pressure chamber walls on a surface of the diaphragm on an opposite side to the piezoelectric body; a discharge hole plate bonding step of bonding a discharge hole plate formed with discharge holes which discharge the liquid held in pressure chambers, onto the pressure chamber walls; and a base substrate removing step of removing at least a portion of the base substrate, wherein temperature T of the heat treatment step satisfies the following relationship: $T=(c/|a-b|)+Tc$, where Tc represents room temperature, a represents a coefficient of thermal expansion of the base substrate, b represents a coefficient of thermal expansion of the piezoelectric body, and c represents a difference in thermal change.

More specifically, since the material of the base substrate and the temperature of the heat treatment process for sintering the piezoelectric film by applying heat to same are selected in such a manner that the difference in thermal change, c, during heat treatment is a prescribed value, then it is possible to reduce the difference in the amount of extension (rate of expansion) of the base substrate and the piezoelectric body during heat treatment. Therefore, warping of the piezoelectric body and the base substrate on which the piezoelectric body is formed can be reduced.

The normal temperature Tc may be an environmental temperature during subsequent steps after the heat treatment process (namely, the diaphragm forming step, the pressure chamber forming step, or the like).

Preferably, the difference in thermal change, c, satisfies the following relationship: $c \leqq 5.0\times10^{-3}$.

Preferably, at least the piezoelectric film is formed by means of an aerosol deposition method.

If an aerosol deposition method is used, in which a particulate material sprayed from a spray hole known as an aerosol nozzle is deposited onto the base substrate, in the step of forming the piezoelectric body (piezoelectric film), then it is possible to form piezoelectric bodies of various shapes, and also to improve the bonding characteristics between the base substrate and the piezoelectric body.

Furthermore, even if the piezoelectric body forming surface of the base substrate on which the piezoelectric body is formed comprises an undulated shape or a bent shape, it is still possible to form a piezoelectric body onto the piezoelectric body forming surface.

Preferably, at least one of the diaphragm and the pressure chamber walls is formed by means of an aerosol deposition method.

More specifically, it is possible to prevent warping in the diaphragm and the pressure chamber walls, and furthermore, improved dimensional accuracy can be expected when forming the pressure chambers. Moreover, there is increased freedom of design in respect of the shape of the diaphragm and the pressure chambers. Furthermore, since the piezoelectric body, the diaphragm and the pressure chamber walls are formed by using the same film formation method, it is possible to simplify the manufacturing process.

In a film formation method using aerosol deposition, the respective films are formed in accordance with the shape of a mask, and therefore, it is possible to achieve ultra-fine processing, such as processing without curved edges or tapering, which is very difficult to realize by etching or machine processing.

In order to attain the aforementioned object, the present invention is also directed to a discharge head, comprising: a base substrate; a piezoelectric body formed by a thin film forming technique on at least one surface of the base substrate, the piezoelectric body applying a discharge pressure to a droplet of liquid discharged onto a discharge receiving medium; a diaphragm formed by at least one of bonding and film deposition on a surface of the piezoelectric body on an opposite side to the base substrate; pressure chamber walls formed on a surface of the diaphragm on an opposite side to the piezoelectric body; and a discharge hole plate provided with a discharge hole from which the droplet of the liquid is discharged and bonded to the pressure chamber walls on an opposite side to the diaphragm, wherein a ratio b/a between a coefficient of thermal expansion, a, of the base substrate and a coefficient of thermal expansion, b, of the piezoelectric body is within a prescribed range.

In other words, it is possible to reduce warping of the piezoelectric body and the substrate after sintering of the piezoelectric film, by means of the base substrate on which the piezoelectric body is formed. Furthermore, by adopting a composition in which at least a portion of the base substrate is left, rather than removing the base substrate completely, it is possible to increase the rigidity of the upper portions of the pressure chamber walls, thus helping to prevent cross-talk during liquid discharge.

Preferably, the ratio b/a between the coefficient of thermal expansion, a, of the base substrate and the coefficient of thermal expansion, b, of the piezoelectric body satisfies the following relationship: $0.6 \leqq (b/a) \leqq 1.4$.

Preferably, the base substrate includes at least one of a stainless steel, crystallized glass and Fe—Ni alloy.

More specifically, stainless steel, or crystallized glass, or Fe—Ni alloy are base substrate materials that are suitable for mass production, due to their cost and ease of processing. The stainless steel plate may also include SUS 430.

Preferably, the base substrate is made from same material as the piezoelectric body.

Since the base substrate on which the piezoelectric body is formed is made of the same material as the piezoelectric body, it is possible to prevent warping during heat treatment and warping upon cooling to normal temperature after heat treatment.

Preferably, at least a portion of the base substrate has been removed.

More specifically, since the base substrate forms a sacrificial layer which is removed, apart from the required regions thereof, then various types of materials can be used for the base substrate. The regions where the base substrate is removed may include the individual electrode forming region, where drive voltages are applied to the piezoelectric body, and desirably, they include the individual electrode forming region and the region of the wiring leads for the individual electrodes (pad regions).

According to the present invention, since a composition is adopted in which a material having a coefficient of thermal expansion near that of the piezoelectric body is used as the material for the base substrate on which the piezoelectric film is formed, and a heat treatment step for sintering the piezoelectric film by applying heat to same is carried out after forming the piezoelectric film on the base substrate, then it is possible to reduce the warping of the piezoelectric body and the base substrate during the heat treatment step. Furthermore, since the steps of bonding a diaphragm or forming a diaphragm by film deposition, forming the pressure chamber walls, and bonding a discharge hole plate to the pressure chamber walls, are carried out in subsequent steps after heat treatment has been performed, it is possible to prevent warping in the head as a whole. The same material may be used for the base substrate and the piezoelectric body.

Furthermore, since an aerosol deposition method is used in the film formation step for forming a piezoelectric body, the processing accuracy of the respective films (plates) is improved, and the freedom of design in respect of the shapes of the respective films can be increased. It should be noted that aerosol deposition may also be used for other film formation steps, such as the steps of forming the pressure chamber walls, the diaphragm plate, or the like.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 11 is a diagram showing the bonding results for laminated members at respective heat treatment temperatures on the basis of various differentials between the coefficients of thermal expansion;

FIG. 12 is a diagram showing results relating to warping of a base substrate after forming a piezoelectric film, for various base substrates on which the piezoelectric body 58 is formed and for various heat treatment temperatures;

DETAILED DESCRIPTION OF THE PREFERRED EMBODIMENTS

General Configuration of an Inkjet Recording Apparatus

Figure 1:
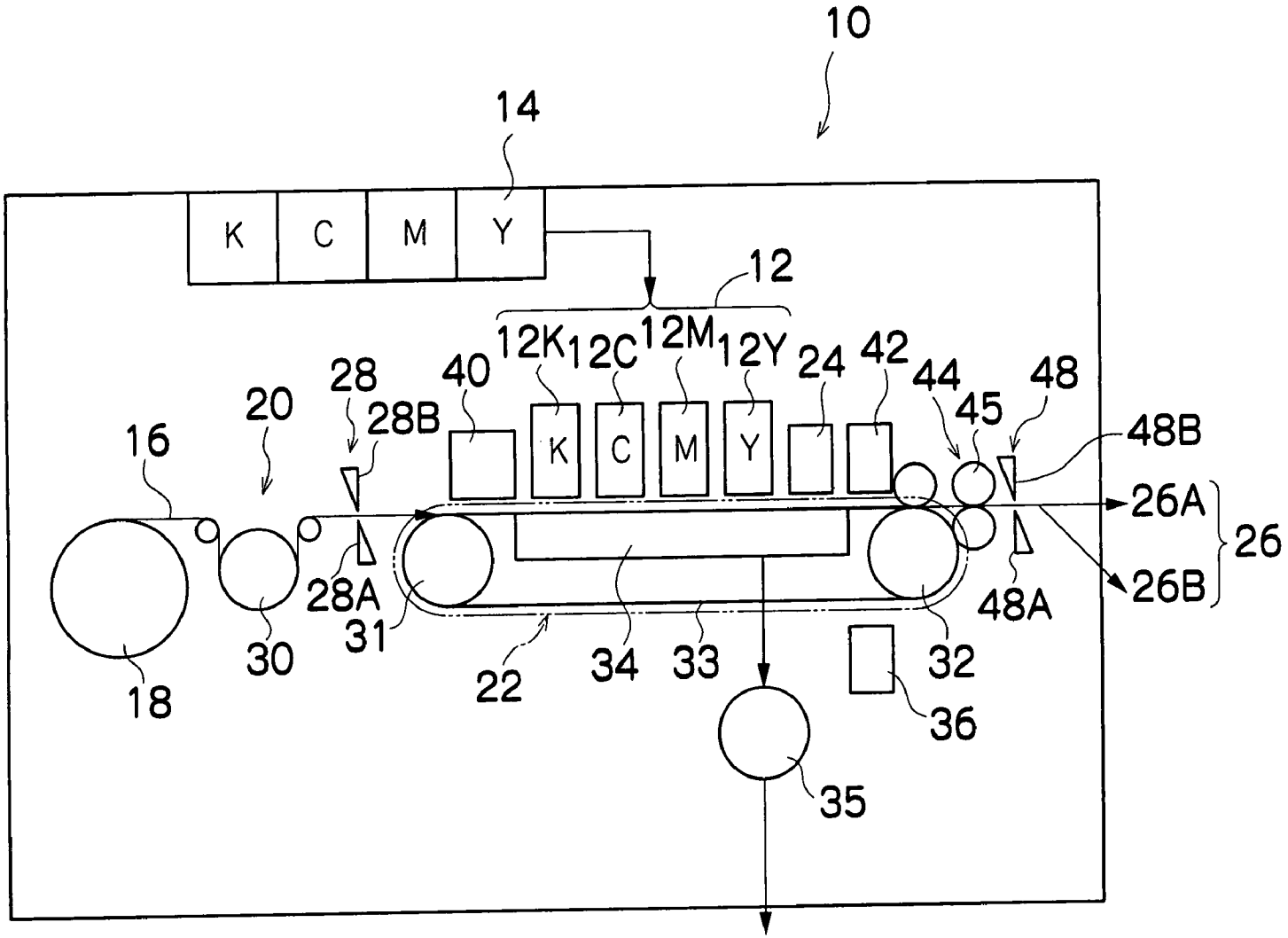
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet discharge is controlled so that the ink-droplets are discharged in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown in FIG. 1, but shown as a motor 88 in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
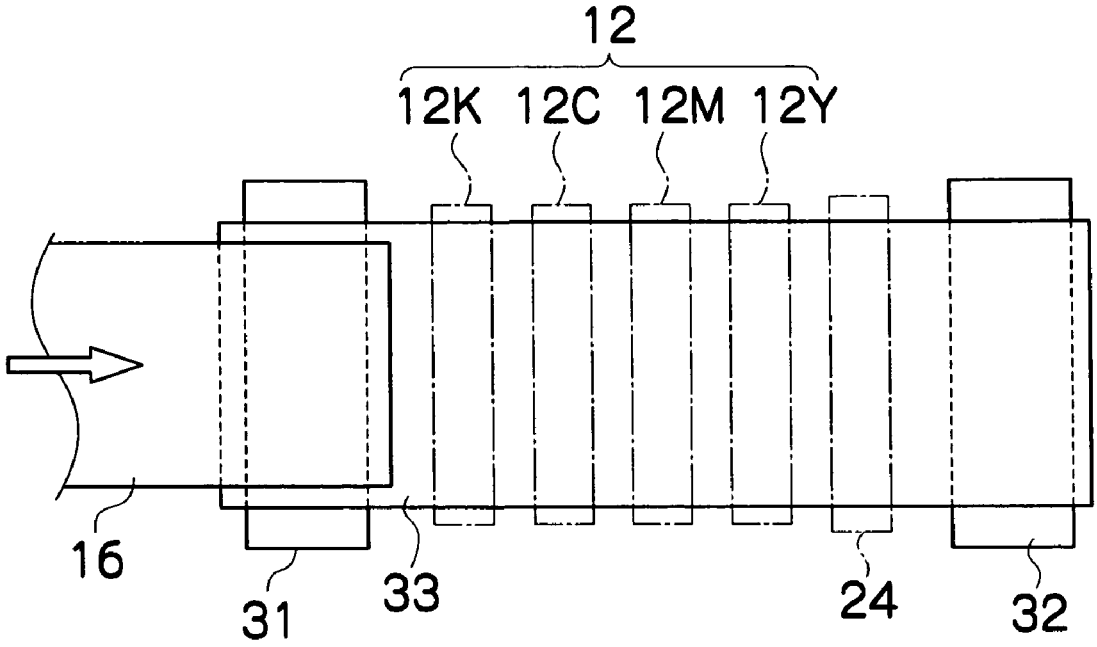
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. A specific structural example is described later with reference to FIGS. 3A to 5. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

The printing unit 12, in which the full-line heads covering the entire width of the paper are thus provided for the respective ink colors, can record an image over the entire surface of the recording paper 16 by performing the action of moving the recording paper 16 and the printing unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

As shown in FIG. 1, the ink storing and loading unit 14 has tanks for storing the inks of K, C, M and Y to be supplied to the print heads 12K, 12C, 12M, and 12Y, and the tanks are connected to the print heads 12K, 12C, 12M, and 12Y through channels (not shown), respectively. The ink storing and loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position.

The post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

The heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Next, the structure of the print heads is described. The print heads 12K, 12C, 12M and 12Y have the same structure, and a reference numeral 50 is hereinafter designated to any of the print heads 12K, 12C, 12M and 12Y.

Figure 3A:
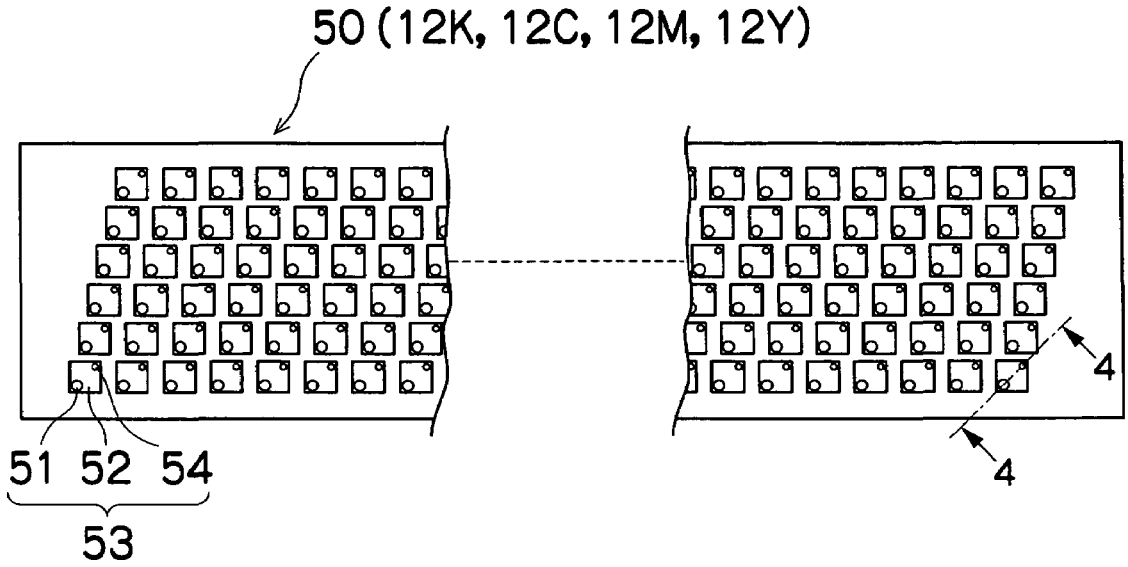
FIG. 3A is a perspective plan view showing an example of a configuration of a print head.
Figure 3B:
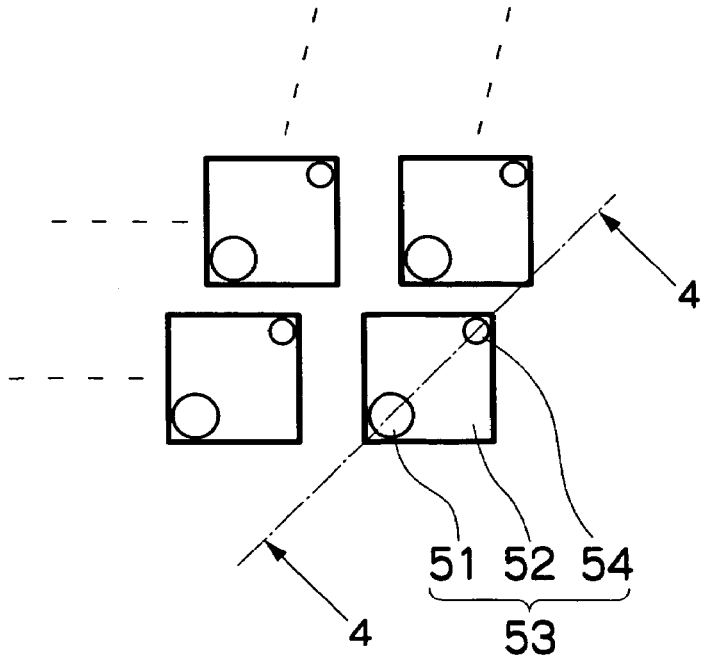
FIG. 3B is a partial enlarged view of FIG. 3A.
Figure 3C:
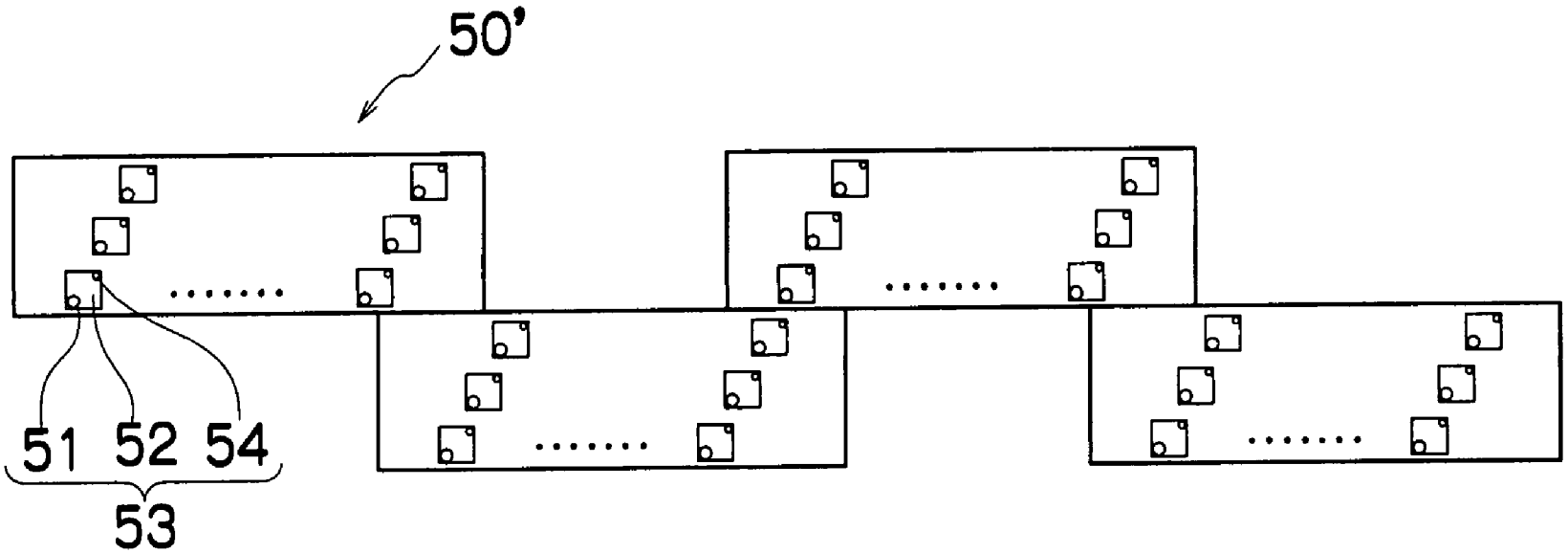
FIG. 3C is a perspective plan view showing another example of the configuration of the print head.
Figure 4:
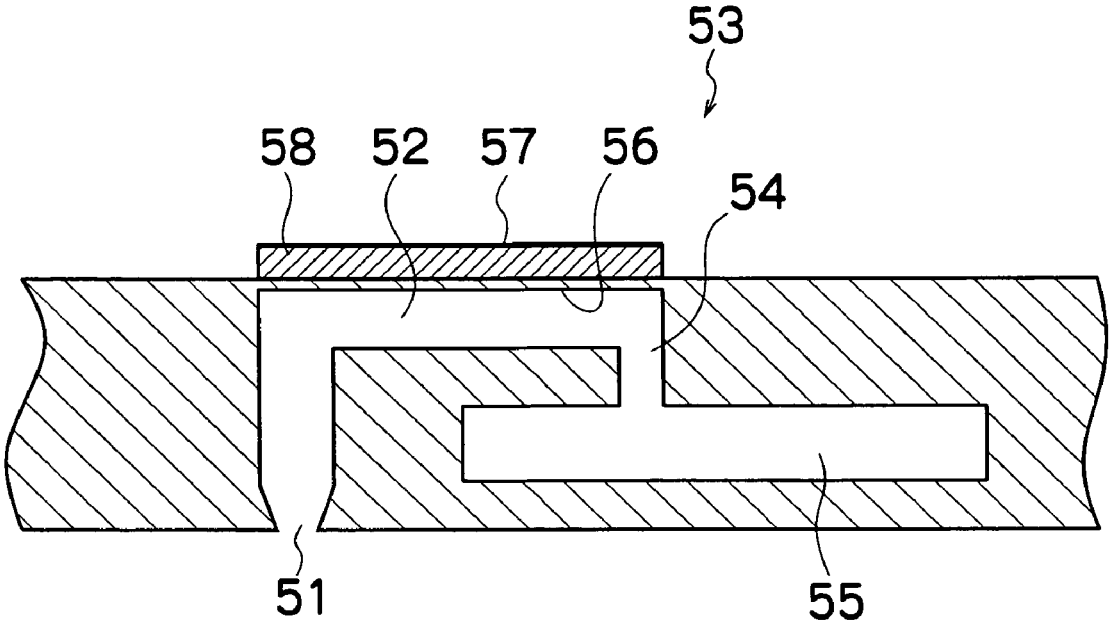
FIG. 4 is a cross-sectional view along a line 4-4 in FIGS. 3A and 3B.

FIG. 3A is a perspective plan view showing an example of the configuration of the print head 50, FIG. 3B is an enlarged view of a portion thereof, FIG. 3C is a perspective plan view showing another example of the configuration of the print head, and FIG. 4 is a cross-sectional view taken along the line 4-4 in FIGS. 3A and 3B, showing the inner structure of an ink chamber unit.

The nozzle pitch in the print head 50 should be minimized in order to maximize the density of the dots printed on the surface of the recording paper. As shown in FIGS. 3A, 3B, 3C, and 4, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

Thus, as shown in FIGS. 3A and 3B, the print head 50 in the present embodiment is a full-line head in which one or more of nozzle rows in which the ink discharging nozzles 51 are arranged along a length corresponding to the entire width of the recording medium in the direction substantially perpendicular to the conveyance direction of the recording medium.

Alternatively, as shown in FIG. 3C, a full-line head can be composed of a plurality of short two-dimensionally arrayed head units 50' arranged in the form of a staggered matrix and combined so as to form nozzle rows having lengths that correspond to the entire width of the recording paper 16.

The planar shape of the pressure chamber 52 provided for each nozzle 51 is substantially a square, and the nozzle 51 and an inlet of supplied ink (supply port) 54 are disposed in both corners on a diagonal line of the square. Each pressure chamber 52 is connected to a common channel 55 (shown in FIG. 4) through the supply port 54.

An actuator 58 having a discrete electrode 57 is joined to a pressure plate 56, which forms the ceiling of the pressure chamber 52, and the actuator 59 is deformed by applying drive voltage to the discrete electrode 57 to eject ink from the nozzle 51. When ink is ejected, new ink is delivered from the common flow channel 55 through the supply port 54 to the pressure chamber 52.

Figure 5:
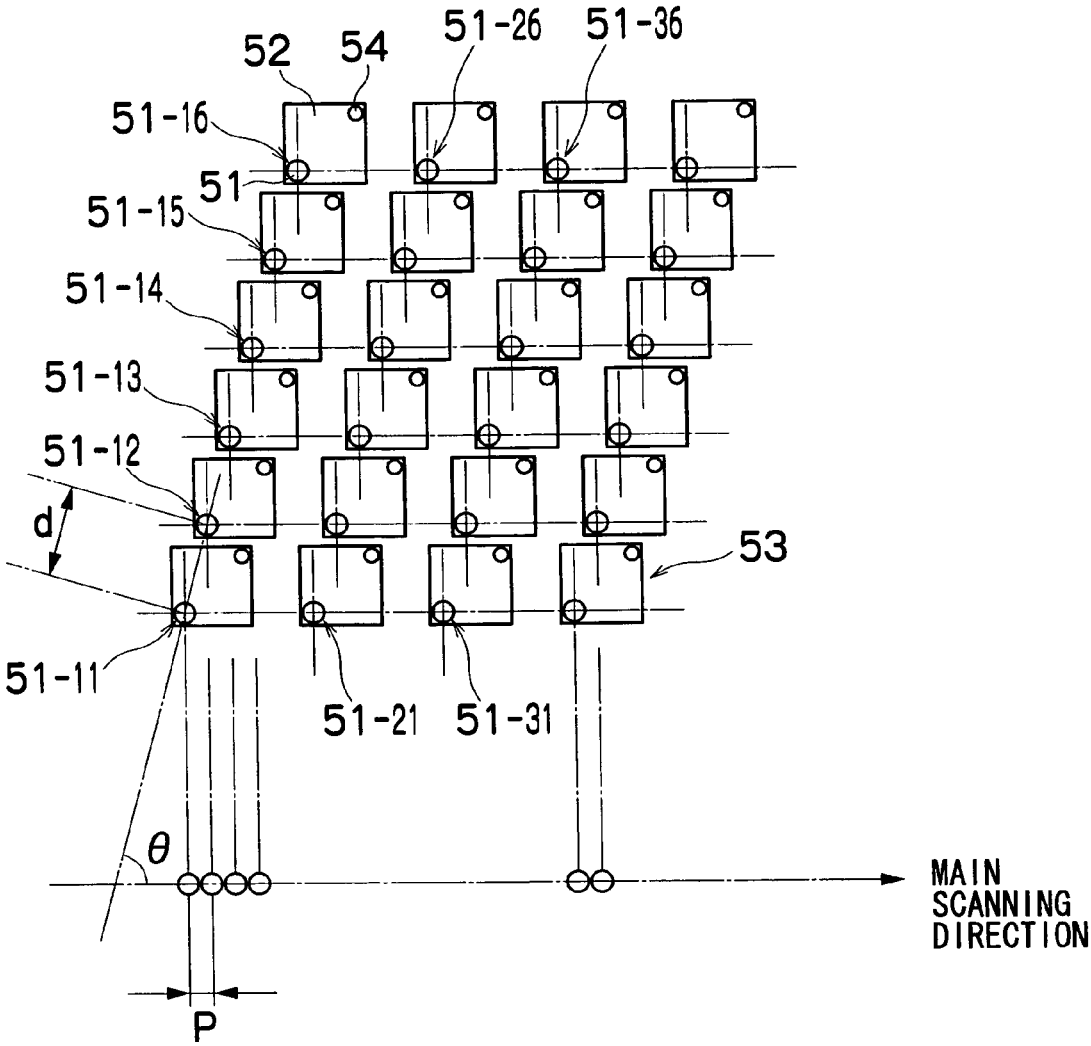
FIG. 5 is an enlarged view showing nozzle arrangement of the print head in FIGS. 3A, 3B, and 3C.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle θ with respect to the main scanning direction, the nozzle pitch P as projected in the main scanning direction is $d \times \cos\theta$.

Hence, the nozzles 51 can be regarded to be equivalent to those arranged at a fixed pitch P on a straight line along the main scanning direction. Such configuration results in a nozzle structure in which the nozzle row projected in the main scanning direction has a high nozzle density of up to 2,400 nozzles per inch (npi).

In a full-line head comprising rows of nozzles that have a length corresponding to the entire width of the paper (the recording paper 16), the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

In implementing the present invention, the arrangement of the nozzles is not limited to that of the example illustrated. Moreover, a method is employed in the present embodiment where an ink droplet is ejected by means of the deformation of the actuator 59, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure of these bubbles.

Figure 6:
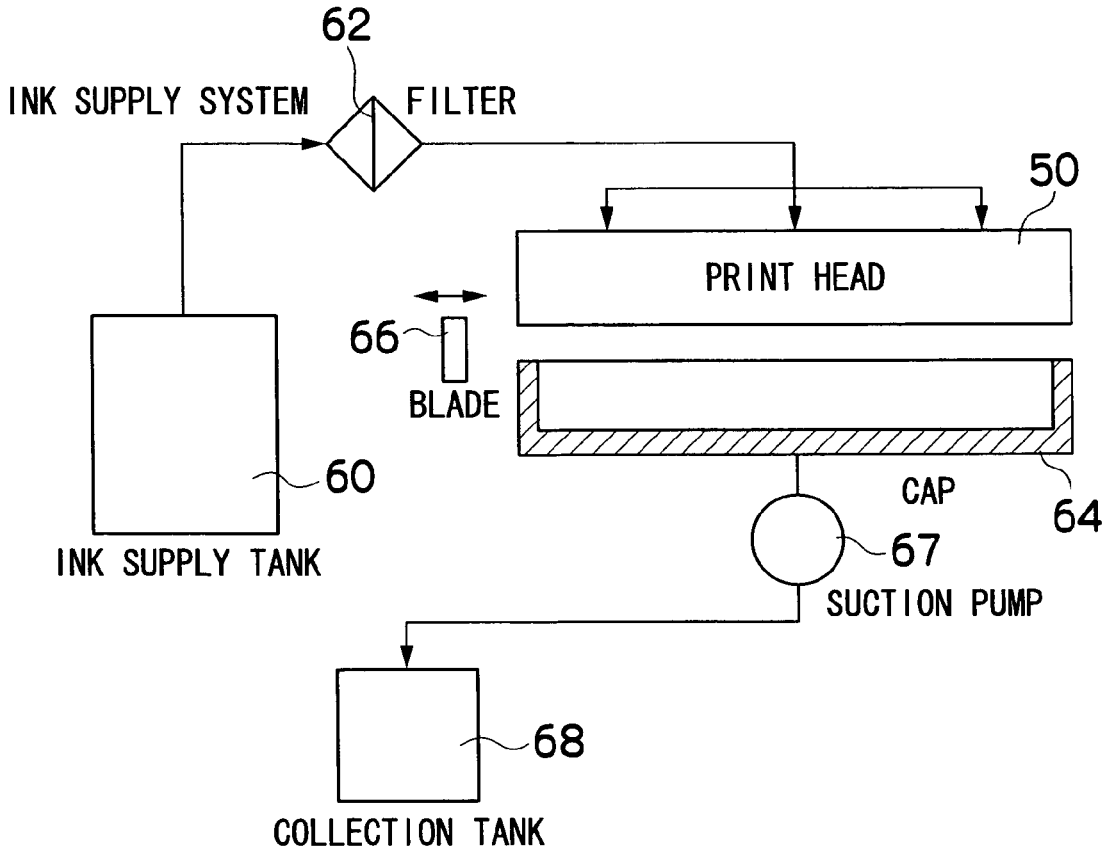
FIG. 6 is a schematic drawing showing a configuration of an ink supply system in the inkjet recording apparatus.

FIG. 6 is a schematic drawing showing the configuration of the ink supply system in the inkjet recording apparatus 10. An ink supply tank 60 is a base tank that supplies ink and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing and loading unit 14 in FIG. 1 described above.

A filter 62 for removing foreign matters and bubbles is disposed between the ink supply tank 60 and the print head 50 as shown in FIG. 6. The filter mesh size in the filter 62 is preferably equivalent to or less than the diameter of the nozzle and commonly about 20 μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face.

A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face is thereby covered with the cap 64.

The cleaning blade 66 is composed of rubber or another elastic member, and can slide on the ink discharge surface (surface of the nozzle plate) of the print head 50 by means of a blade movement mechanism (not shown). When ink droplets or foreign matter has adhered to the nozzle plate, the surface of the nozzle plate is wiped, and the surface of the nozzle plate is cleaned by sliding the cleaning blade 66 on the nozzle plate.

During printing or standby, when the frequency of use of specific nozzles is reduced and ink viscosity increases in the vicinity of the nozzles, a preliminary discharge is made toward the cap 64 to discharge the degraded ink.

Also, when bubbles have become intermixed in the ink inside the print head 50 (inside the pressure chamber), the cap 64 is placed on the print head 50, ink (ink in which bubbles have become intermixed) inside the pressure chamber is removed by suction with a suction pump 67, and the suction-removed ink is sent to a collection tank 68. This suction action entails the suctioning of degraded ink whose viscosity has increased (hardened) when initially loaded into the head, or when service has started after a long period of being stopped.

When a state in which ink is not discharged from the print head 50 continues for a certain amount of time or longer, the ink solvent in the vicinity of the nozzles 51 evaporates and ink viscosity increases. In such a state, ink can no longer be discharged from the nozzle 51 even if the actuator 59 is operated. Before reaching such a state the actuator 59 is operated (in a viscosity range that allows discharge by the operation of the actuator 59), and the preliminary discharge is made toward the ink receptor to which the ink whose viscosity has increased in the vicinity of the nozzle is to be discharged. After the nozzle surface is cleaned by a wiper such as the cleaning blade 66 provided as the cleaning device for the nozzle face, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be discharged by the preliminary discharge, and a suctioning action is carried out as follows.

More specifically, when bubbles have become intermixed in the ink inside the nozzle 51 and the pressure chamber 52, ink can no longer be discharged from the nozzles even if the actuator 59 is operated. Also, when the ink viscosity inside the nozzle 51 has increased over a certain level, ink can no longer be discharged from the nozzle 51 even if the actuator 59 is operated. In these cases, a suctioning device to remove the ink inside the pressure chamber 52 by suction with a suction pump, or the like, is placed on the nozzle face of the print head 50, and the ink in which bubbles have become intermixed or the ink whose viscosity has increased is removed by suction.

However, this suction action is performed with respect to all the ink in the pressure chamber 52, so that the amount of ink consumption is considerable. Therefore, a preferred aspect is one in which a preliminary discharge is performed when the increase in the viscosity of the ink is small.

Figure 7:
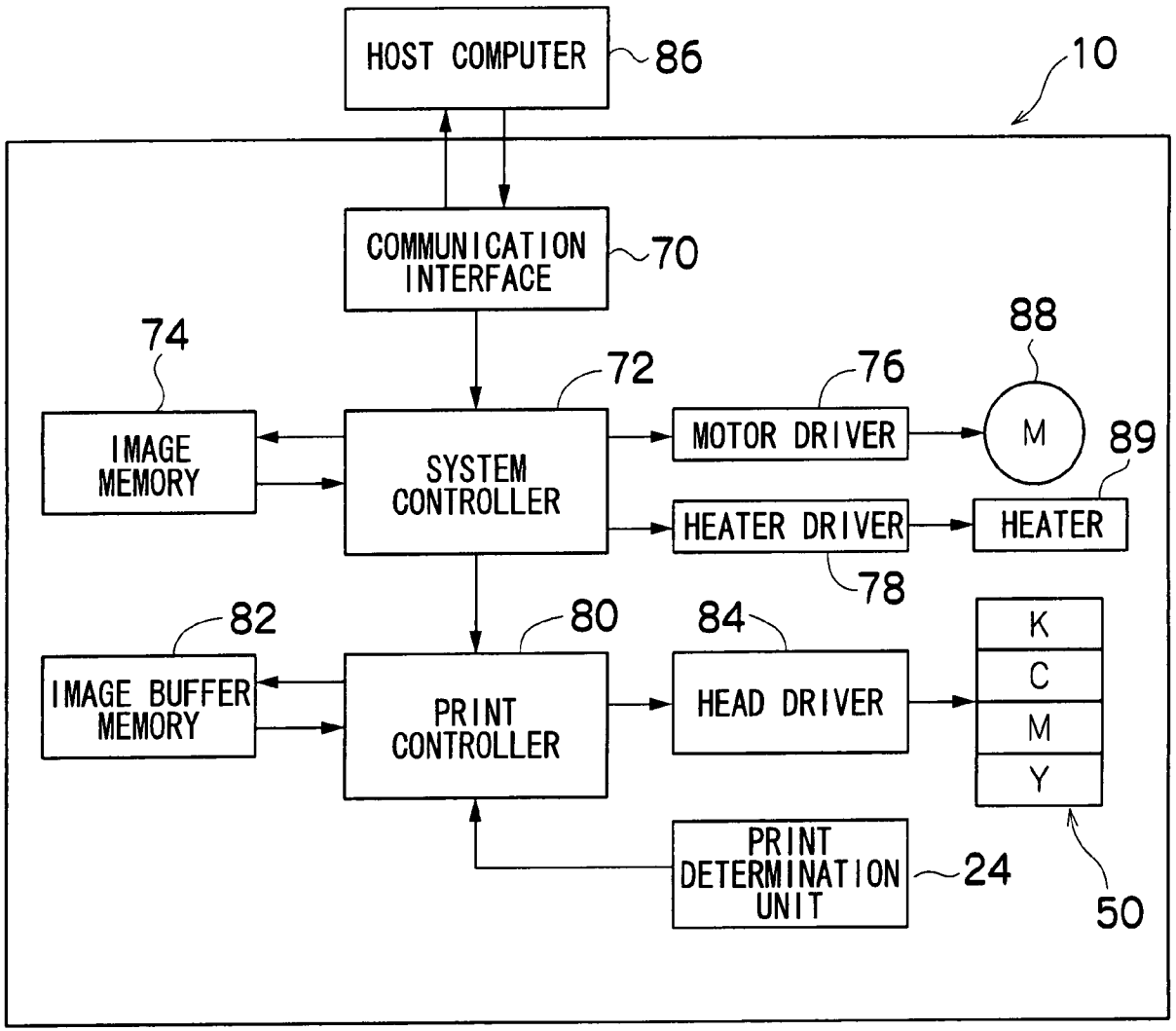
FIG. 7 is a principal block diagram showing the system composition of the inkjet recording apparatus.

FIG. 7 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print control unit 80 is a control unit having a signal processing function for performing various treatment processes, corrections, and the like, in accordance with the control implemented by the system controller 72, in order to generate a signal for controlling printing, from the image data in the image memory 74, and it supplies the print control signal (image data) thus generated to the head driver 84. Prescribed signal processing is carried out in the print control unit 80, and the discharge amount and the discharge timing of the ink droplets from the respective print heads 50 are controlled via the head drier 84, on the basis of the image data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators 59 for the print heads 12K, 12C, 12M and 12Y of the respective colors on the basis of the print data received from the print controller 80. A feedback control system for keeping the drive conditions for the print heads constant may be included in the head driver 84.

Various control programs are stored in a program storage section (not illustrated), and a control program is read out and executed in accordance with commands from the system controller 72. The program storage section may use a semiconductor memory, such as a ROM, EEPROM, or a magnetic disk, or the like. An external interface may be provided, and a memory card or PC card may also be used. Naturally, a plurality of these storage media may also be provided.

The program storage section may also be combined with a storage device for storing operational parameters, and the like (not illustrated).

As shown in FIG. 1, the print detection unit 24 is a block including a line sensor, which reads in the image printed onto the recording paper 16, performs various signal processing operations, and the like, and detects the print situation (presence/absence of discharge, variation in droplet ejection, etc.), these detection results being supplied to the print controller 80.

Furthermore, according to requirements, the print controller 80 makes various corrections with respect to the print head 50 on the basis of information obtained from the print determination unit 24.

In the example shown in FIG. 1, the print determination unit 24 is provided on the print surface side, the print surface is irradiated with a light source (not illustrated), such as a cold cathode fluorescent tube disposed in the vicinity of the line sensor, and the reflected light is read in by the line sensor. However, in implementing the present invention, another composition may be adopted.

In the present embodiment, a full line type of print head is described as an example of a print head, but the present invention may also be applied to a shuttle type head.

Method for Manufacturing Print Head

Next, a method for manufacturing the print head 50 relating to the present invention will be described.

As shown by the three-dimensional structural view in FIG. 4, the print head 50 has a laminated structure in which a plurality of thin films (cavity plates) are layered together. Aerosol deposition method is the principal method used to form the films constituting the respective layers.

Here, an overview of a film formation method based on the aerosol deposition method is described with reference to FIG. 8.

Figure 8:
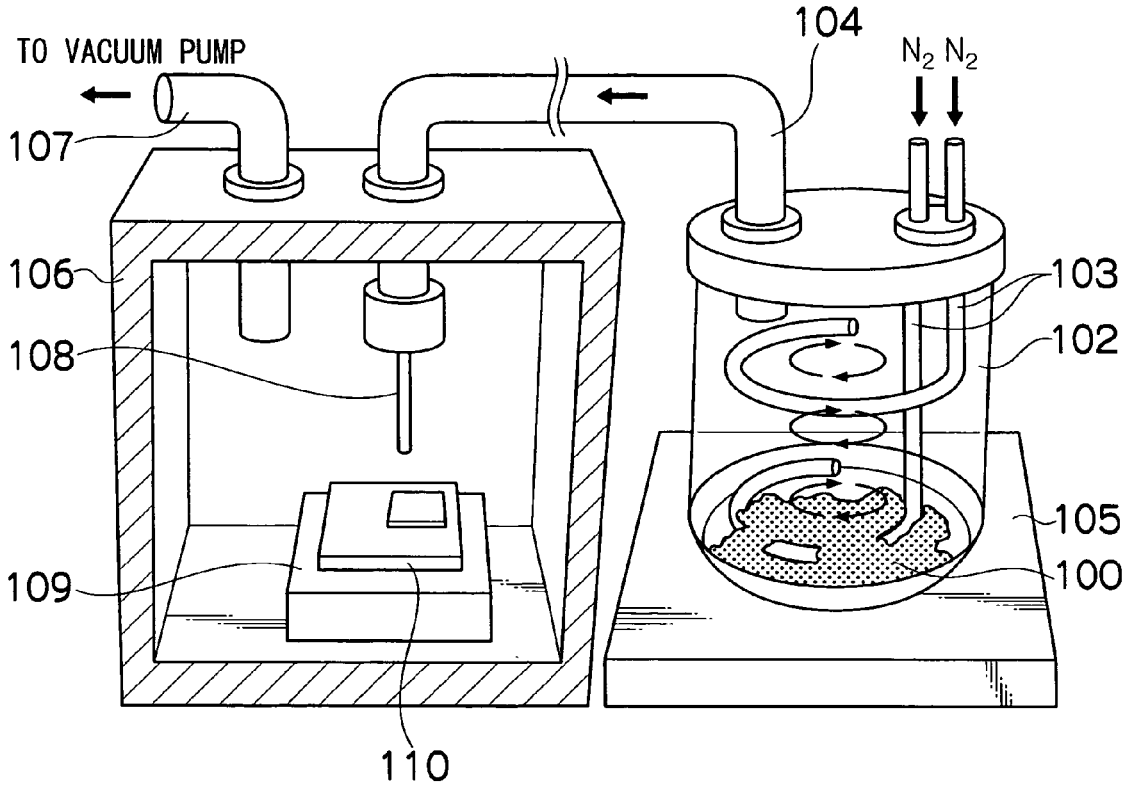
FIG. 8 is a schematic drawing showing a film formation device based on an aerosol deposition method.

FIG. 8 is a schematic drawing showing a film formation device based on the aerosol deposition method. This film formation device has an aerosol generating chamber 102 which accommodates a raw material powder 100. Here, an "aerosol" refers to fine particles of a solid or liquid which are suspended in a gas.

A carrier gas input section 103, an aerosol output section 104, and a vibrating unit 105 are attached to the aerosol generating chamber 102. An aerosol is generated by introducing a gas, such as nitrogen gas, via the carrier gas input section 103 and thus blowing and lifting the raw material powder that is accommodated in the aerosol generating chamber 102. In this case, by applying a vibration to the aerosol generating chamber 102 by means of the vibrating unit 105, the raw material powder is churned up and an aerosol is generated efficiently. The aerosol thus created is channeled through the aerosol output section 104 to a film formation chamber 106.

An exhaust tube 107, a nozzle 108 and a movable stage 109 are provided at the film formation chamber 106. The exhaust tube 107 is connected to a vacuum pump and evacuates the interior of the film formation chamber 106. The aerosol generated in the aerosol generating chamber 102 and conducted to the film formation chamber 106 via the aerosol output section 104 is sprayed from the nozzle 108 onto a substrate 110. In this way, the raw material powder collides with and builds up on the substrate 110. The substrate 110 is mounted on a movable stage 109 that is capable of three-dimensional movement, and hence the relative positions of the substrate 110 and the nozzle 108 can be adjusted by controlling the movable stage 109.

Films forming the respective layers of the laminated structure are created in this way, the plurality of films being formed by switching the aerosol that is sprayed from the nozzle 108. Various materials, such as metals, metal oxides, silicon, or the like, can be formed by the aerosol deposition method.

Next, the method for manufacturing the print head 50 is described in terms of a sequence of processing steps.

FIGS. 9A to 9K show manufacturing steps for a print head 50 comprising a split mechanism type piezoelectric body. In FIGS. 9A to 9K, items which are the same as or similar to those in FIG. 4 are labeled with the same reference numerals and description thereof is omitted here. In FIG. 4, the nozzles are formed on the bottommost face of the ink chamber unit 53, but in FIGS. 9A to 9K, for the sake of convenience, the illustrations are inverted with respect to FIG. 4, and hence the surface containing the nozzles is uppermost in FIGS. 9A to 9K.

Figure 9A:
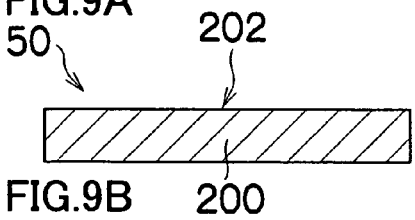
FIGS. 9A to 9K are diagrams showing manufacturing steps for a print head relating to the present embodiment.

FIG. 9A shows a base substrate 200 forming the base of a laminated structure as described above. The base substrate 200 in FIGS. 9A to 9K corresponds to the substrate 110 in FIG. 8.

A piezoelectric body, and the like, is formed on either one of the broad surfaces of the base substrate 200. In FIGS. 9A to 9K, the upper surface of the base substrate 200 is the piezoelectric body forming surface 102.

For the base substrate 200, a material having a coefficient of thermal expansion that is close to that of the material of the piezoelectric body formed on the base substrate 200 (not illustrated in FIG. 9A and labeled with reference numeral 58 in FIG. 4 and FIG. 9D) is used, for instance, SUS430 (stainless steel), an Fe—Ni alloy having the tradename of "Invar", a machinable glass (crystallized glass) having the tradename of "Macor", or the like. Naturally, it is also possible to use the same material as the piezoelectric body, for instance, PZT (lead zirconate titanate ($Pb(Zr, Ti)O_3$)), or the like.

Figure 10A:
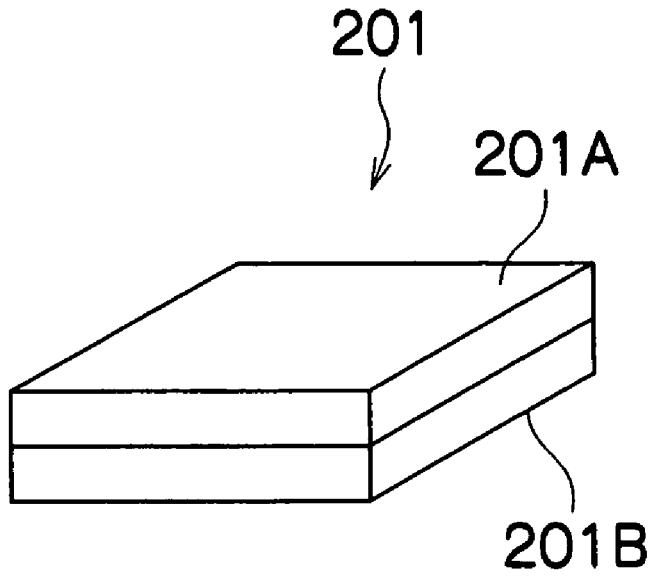
FIGS. 10A and 10B are diagrams illustrating warping of a laminated member including a plurality of layers, due to difference between the coefficients of thermal expansion of the respective members.

Here, the coefficient of thermal expansion indicates the rate of change in the length and volume of a material with respect to unit temperature change. In other words, if heat is applied to a coupled body 201 formed by bonding two different members 201A and 201B as illustrated in FIG. 10A, then since the change in the length (volume) of the respective members due to the heat is different because of their different coefficients of thermal expansion, warping may occur in the coupled body.

Figure 10B:
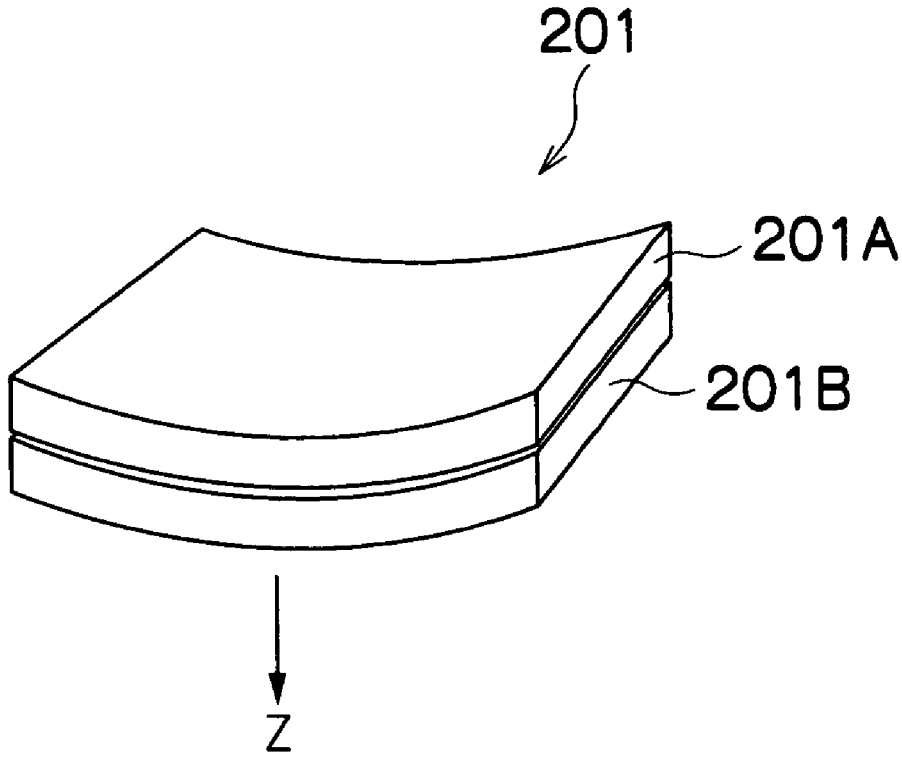

For example, if the member 201 is heated (in other words, if a positive temperature change is applied), then if the coefficient of thermal expansion of the member 201A is smaller than the coefficient of thermal expansion of the member 201B, the change in the volume (namely, the expansion) of member 201B will be greater than the change in the volume of member 201A. Consequently, the member 201 will warp in such a manner that the central portion of the member 201 bends downwards in FIG. 10B (towards the member 201B experiencing the greater expansion). Moreover, if there is a large difference between the volume changes in the two members, then the members may peel apart. In FIG. 10, direction Z marked by the arrow indicates the direction of displacement of the central portion of the base substrate 200. The amount of bend tends to increase, the greater the difference in coefficient of thermal expansion between the two members 201A and 201B.

Therefore, in a coupled body formed by bonding together a plurality of members, it is necessary to select the members in such a manner that there is little difference between their respective coefficients of thermal expansion, in order to prevent warping or peeling apart.

Figure 9B:
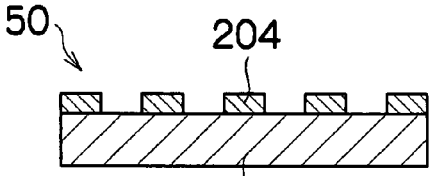

Next, a masking process is described in FIG. 9B. Firstly, the region of the piezoelectric body forming surface 202 of the base substrate 200 where electrodes and wiring are not to be formed (not illustrated in FIG. 9B and indicated by reference numeral 240 in FIG. 15) is masked by a resist pattern 204. The steps in FIGS. 9A to 9K show a mode where a plurality of pressure chambers having the same structure are formed. Therefore, constituent members of the pressure chambers which are the same in each chamber are only labeled with respect to one of the pressure chambers in the diagram.

Figure 9C:
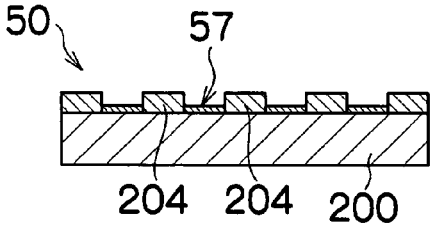

FIG. 9C shows a step for creating individual electrodes. After the masking step shown in FIG. 9B, an individual electrode 57 and wiring for same are formed in the unmasked region of the resist pattern 204. A thin film of metal, such as gold (Au), copper (Cu), platinum (Pt), or the like, or a thin film of metal oxide, such as titanium oxide ($TiO_2$) is used to form the individual electrode 57 and wiring. The individual electrode 57 and wiring may be used within the same layer, or an independent electrode layer (not illustrated) containing at least the individual electrode 57, and a wiring layer (not illustrated) containing at least the wiring, may be formed in mutually separate fashion.

In the individual electrode forming step shown in FIG. 9C, metal thin films forming individual electrodes 57 are created by the aerosol deposition method. Apart from the aerosol deposition method, another film forming technique, such as sputtering, may be used in the individual electrode forming step.

Figure 9D:
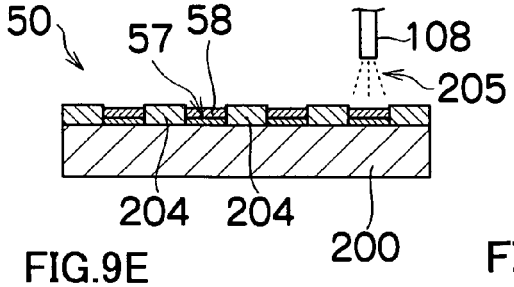

Next, the piezoelectric body forming step and heat treatment step are illustrated in FIG. 9D. After the individual electrode forming step shown in FIG. 9C, micro-particles of piezoelectric material 205 sprayed from the nozzle 108 are deposited by the aerosol deposition method onto the surface of the base substrate 200 that is opposite to the individual electrodes 57. Piezoelectric bodies 58 (which correspond to the actuator 58 in FIG. 4) are formed by these micro-particles of piezoelectric material 205.

For the material of the piezoelectric bodies 58 (namely, the micro-particles of piezoelectric material 205), it is possible to use a piezoelectric ceramic, such as lead zirconate titanate, barium titanate ($BaTiO_3$), or the like.

After depositing the material of the piezoelectric bodies 58 on the individual electrodes 57 by the aerosol deposition method, heat treatment is carried out in order to sinter the piezoelectric bodies 58. In this heat treatment step, the piezoelectric bodies 58 are formed by sintering the piezoelectric material at a treatment temperature which does not cause diffusion of the substrate.

In this example, a material having a coefficient of thermal expansion close to that of the piezoelectric bodies 58 is used for the base substrate 200, and the base substrate 200 is subjected to heat treatment when forming the piezoelectric bodies 58. Therefore, it is possible to prevent warping due to difference between the amount of expansion of the piezoelectric bodies 58 and the base substrate 200 when heat is applied, or difference between the amount of contraction thereof when they return to normal temperature.

Here, the coefficients of thermal expansion of the base substrate 200 and the piezoelectric body 58 will be described.

FIG. 11 shows the warp in the base substrate 200 (piezoelectric bodies 58) and the state of the bonding between the base substrate 200 and the piezoelectric bodies 58, when the difference k between the coefficient of thermal expansion a of the substrate and the coefficient of thermal expansion b of the piezoelectric bodies 58 obeys the relationship illustrated in the following expression (1):

$$k=\{(b-a)/a\}\times 100(\%). \quad (1)$$

According to FIG. 11, when the difference between the coefficients of thermal expansion of the base substrate 200 and the piezoelectric bodies 58 is 40% and the heat treatment temperature is 600° C., then the bond between the base substrate 200 and the piezoelectric bodies 58 peels apart, and even if the temperature is 200° C., warping exceeding the range of tolerance occurs. Therefore, the difference between the coefficient of thermal expansion a of the base substrate 200 and the coefficient of thermal expansion b of the piezoelectric bodies 58 is as shown in the following relationship (2):

$$-40(\%)<k<40(\%). \quad (2)$$

The relationship (2) can be expressed as the following relationship (3), by using the ratio of the coefficient of thermal expansion b of the piezoelectric bodies 58 with respect to the coefficient of thermal expansion a of the base substrate 200, namely, the ratio (b/a):

$$0.6\leqq(b/a)\leqq 1.4. \quad (3)$$

Furthermore, if the difference between the coefficients of thermal expansion is 30%, then although warping occurs in the base substrate 200 at a heat treatment temperature of 600° C., this warping is within a tolerable range. Moreover, if the difference between the coefficients of thermal expansion is 4%, then no warping occurs in the base substrate 200.

In other words, desirably, the difference between the coefficient of thermal expansion a of the base substrate 200 and the coefficient of thermal expansion b of the piezoelectric bodies 58 obeys the following relationship (4):

$$-30(\%)<k<30(\%). \quad (4)$$

The relationship (4) may also be expressed as the following relationship (5):

$$0.7<(b/a)<1.3. \quad (5)$$

Furthermore, FIG. 12 shows results for warping of the base substrate 200 after forming the piezoelectric bodies 58, when the base substrate 200 on which the piezoelectric bodies 58 (PZT) are formed, and the heat treatment temperature T, are varied.

The range of the coefficient of thermal expansion b of the piezoelectric bodies (PZT) 58 is $1\times10^{-6}$/° C.≦b≦$1.2\times10^{-5}$/° C., the ratio of the coefficient of thermal expansion b of the piezoelectric bodies 58 with respect to the coefficient of thermal expansion a of the base substrate 200, (b/a) is 0.6≦(b/a)≦1.4, the heat treatment temperature T is T≦1100° C., and normal temperature Tc (room temperature) is Tc=20° C. The value of "normal temperature" is not limited to 20° C., and the ambient temperature of the steps other than heat treatment may also be used.

As shown in FIG. 12, it is possible to prevent warping of the base substrate 200 by selecting the coefficient of thermal expansion b of the base substrate 200 and the heat treatment temperature T in such a manner that the difference in thermal change c expressed in Formula (6) below, which indicates the difference in the extension of the base substrate 200 and the piezoelectric bodies 58 when the base substrate 200 and the piezoelectric bodies 58 are heated, comes within a prescribed range:

$$c=(T-Tc)\times|a-b|(\text{i.e., } T=(c/|a-b|)+Tc). \quad (6)$$

Figure 13:
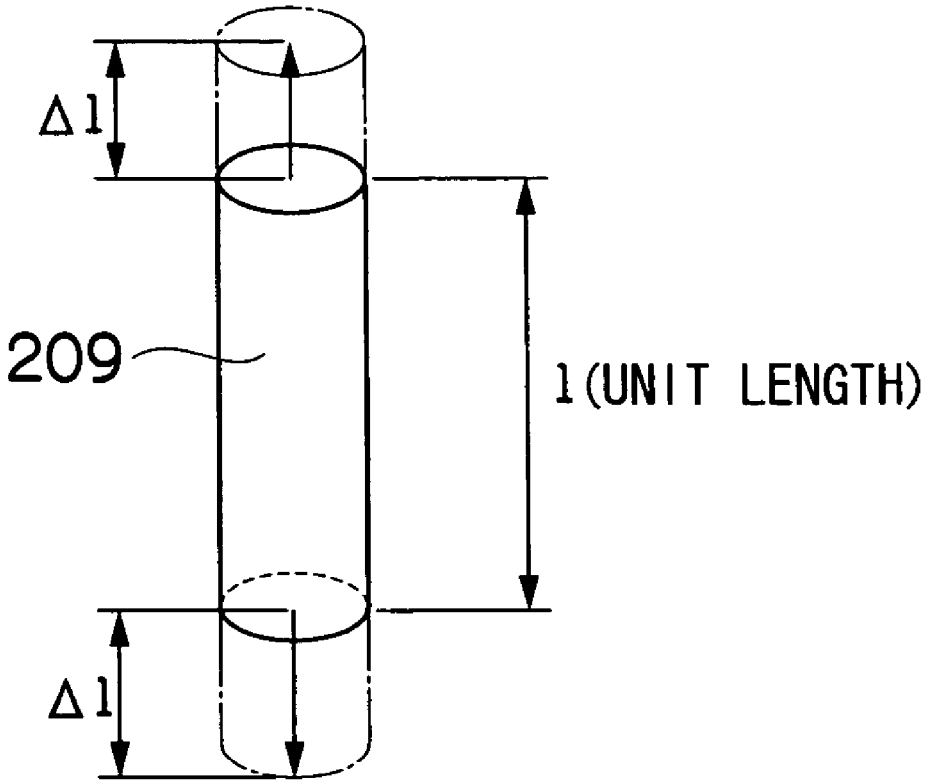
FIG. 13 is a diagram illustrating a coefficient of linear expansion.

The difference in thermal change, c, expressed by (Formula 6) corresponds to the amount of change, Δl of the member 209 shown in FIG. 13 expressed by the relationship in Formula (7) below, where Δl is the amount of change in the unit length l of the member 209 when heat is applied to the member, ΔT is the amount of change in the temperature, l is the length of the member 209, and α is the coefficient of linear expansion:

$$\Delta l=(\Delta T\times\alpha\times 1)/2. \quad (7)$$

The temperature change, ΔT can be expressed as ΔT=T−Tc, and the coefficient of linear expansion α relating to the amount of extension in the lengthwise direction of the member 209, can be expressed as α=|a−b| (namely, the difference between the coefficient of thermal expansion a of the base substrate 200 and the coefficient of thermal expansion b of the piezoelectric body 58.)

In a substance having a uniform molecular structure, the change in volume due to thermal expansion is also uniform. In this case, the coefficient of linear expansion in the same in the x, y and z directions. However, if the molecular structure of the substance is anisotropic, then the coefficient of linear expansion varies according to the direction.

In general, piezoelectric films are very thin and the amount of thermal deformation in the thickness direction can be ignored. Therefore, the thermal deformation can be considered in terms of planar deformation. If a piezoelectric film does not have anisotropy, then the coefficient of linear expansion will be the same in both directions in the plane of the film.

It can be argued that the coefficient of linear expansion is the same, not only in the lengthwise and breadthways directions, but also in the oblique directions, and hence the amount of expansion of the base substrate 200 and the piezoelectric bodies 58 when heated can be considered effectively in terms of the coefficient of linear expansion.

Moreover, the coefficient of thermal expansion (coefficient of linear expansion) does not depend on the size of the member, but in the case of a large member, heat distribution and heat transfer during heating become irregular, and the coefficient of linear expansion will vary when viewed on a micro level. However, in the case of ideal heating conditions, there is no size-dependence of this kind.

In the present example, attention is given to the following directions of thermal deformation during heating of the base substrate 200 and the piezoelectric bodies 58: the lengthwise direction of the print head 50 (a direction substantially perpendicular to the conveyance direction of the recording medium), the breadthways direction of the print head 50 (a direction substantially parallel to the conveyance direction of the recording medium) and the oblique direction within the plane formed by the these two directions (namely, a composite of the lengthwise direction and the breadthways direction).

According to FIG. 12, taking the coefficient of thermal expansion a of the base substrate 200 to be $1.68\times10^{-6}$/° C., the coefficient of thermal expansion b of the piezoelectric bodies 58 to be $1.2\times10^{-6}$/° C., and the heat treatment temperature T to be 1100° C., warping exceeding the tolerable range will occur in the base substrate 200. In this case, the difference in thermal change, c, is $5.18\times10^{-3}$.

Furthermore, if the heat treatment temperature T, of the various conditions which produce the warping in the base substrate 200 is changed from 1100° C. to 1000° C., then warping exceeding a tolerable range does not occur in the base substrate 200.

Therefore, provided that the difference in thermal change, c, is within the range shown in the following relationship (8), then warping exceeding the tolerable range does not occur in the base substrate 200.

$$c \leqq 5.0\times10^{-3}. \quad (8)$$

Figure 9E:
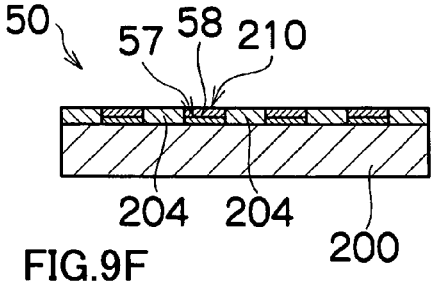

Next, FIG. 9E shows a grinding step. After the heat treatment step described above, in order to maintain the flatness (uniformity) of the surface (diaphragm forming surface) 210 of each piezoelectric body 58 on the opposite side to the individual electrode 57, and to eliminate foreign matter adhering to the diaphragm forming surface 210, the piezoelectric bodies and the resist pattern are subjected to grinding.

When a diaphragm plate (not illustrated in FIG. 9E, and indicated by reference numeral 56 in FIG. 4, FIG. 9F, and the like) is attached to the piezoelectric bodies 58 in the subsequent step, then the surface 210 of the piezoelectric body 58 on which the diaphragm is formed is required to have a prescribed flatness, in order to ensure bonding properties between the piezoelectric bodies 58 and the diaphragm. Furthermore, eliminating foreign matter from the diaphragm forming surface 210 prevents any decline in bonding properties between the piezoelectric bodies 58 and the diaphragm that might be caused by the presence of such foreign matter.

A commonly known method is used for the grinding process. For example, a mechanical or chemical technique may be used.

Figure 9F:
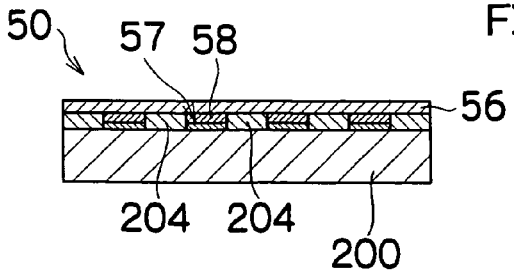

FIG. 9F shows a step for creating a diaphragm. A diaphragm 56, which also serves as a common electrode, is formed on the diaphragm forming surfaces 210 of the piezoelectric bodies 58, which has been flattened by the grinding process in FIG. 9E. A metal material, such as Ni or Cu, is used for the diaphragm 56, and the diaphragm 56 is formed by the aerosol deposition method.

The method used for forming the diaphragm 56 is not limited to the aerosol deposition method, and another type of film formation technique may be used. For instance, a diaphragm 56 formed previously to a prescribed shape and size may be bonded to the piezoelectric bodies 58 (diaphragm forming surfaces 210) by means of an adhesive, or the like.

Figure 9G:
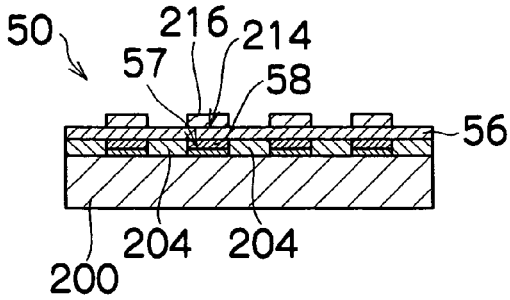

FIG. 9G shows a masking step (pressure chamber forming region masking step). A mask is formed on the pressure chamber forming surface 214 of the diaphragm 56 formed in the diaphragm forming step illustrated in FIG. 9F (namely, on the opposite side to the piezoelectric bodies 58,) by means of a resist pattern 216, in regions where pressure chambers (not illustrated in FIG. 9G and indicated by reference numeral 52 in FIGS. 4 and 9I) are to be formed.

Figure 9H:
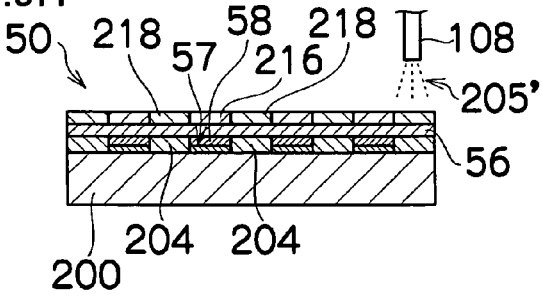

FIG. 9H shows a step for creating pressure chambers. Pressure chamber walls 218 are formed by the aerosol deposition method onto the unmasked regions of the diaphragm 56 which has been masked by the masking step illustrated in FIG. 9G.

A metal such as Ni or Cu is used as the material for the pressure chamber walls 218 (pressure chamber members). More specifically, the pressure chamber walls 218 are formed by depositing metallic micro-particles 205' sprayed from the nozzle 108 onto the region where the pressure chamber walls 218 are to be formed.

From the viewpoint of simplifying the manufacturing process, desirably, the material used for the pressure chamber walls 218 is the same as that used for the diaphragm 56 formed in the diaphragm forming step illustrated in FIG. 9F. For example, if the pressure chamber walls 218 and the diaphragm 56 are formed by the aerosol deposition method using the same material (for example, a metal material, a metal oxide material, a ceramic material, silicon, or the like), then the number of steps for switching the nozzle 108 can be reduced. On the other hand, from the viewpoint of corrosion resistance, desirably, a material having good resistance to ink is used for the pressure chamber walls 218.

Figure 9I:
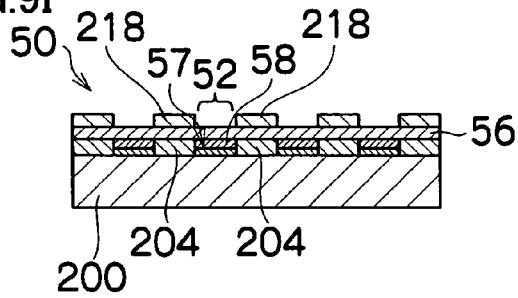

FIG. 9I shows a resist removing step. Unwanted resist is removed in such a manner that the regions which were masked in the pressure chamber forming step shown in FIG. 9H, and where material particles (aerosol) have not be deposited (namely, the masked regions), form spaces which will become pressure chambers 52.

It is also possible to omit the masking process shown in FIG. 9G, to form pressure chamber walls 218 over the whole pressure chamber forming surface of the diaphragm 56 by means of the pressure chamber forming step shown in FIG. 9H, and to then form spaces which will become pressure chambers 52 by excavating the pressure chamber walls 218, instead of the resist removing step illustrated in FIG. 9I. A technique such as anisotropic etching, wet etching, or the like, is used for the excavating process. If pressure chambers 52 are to be formed by anisotropic etching, then silicon should be used as the material for the pressure chamber walls 218. If pressure chambers 52 are to be formed by wet etching, then a metal material, such as stainless steel, should be used as the material for the pressure chamber walls 218.

Figure 9J:
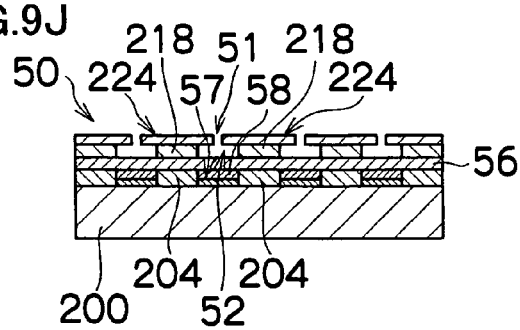

FIG. 9J shows a nozzle plate bonding step (discharge hole plate bonding step). When the pressure chambers 52 have been formed by the resist removal step illustrated in FIG. 9H, a flow channel plate (not illustrated), which is formed with common flow channels (not illustrated in FIGS. 9A to 9K and indicated by reference numeral 55 in FIG. 4) that supply ink from the ink supply system to the pressure chambers 52, a supply port plate (not illustrated), which is formed with support ports (not illustrated in FIGS. 9A to 9K and indicated by reference numeral 54 in FIG. 4) that connect the common flow channels with the pressure chambers 52 and function as an orifice, and a nozzle plate (discharge hole plate) 224, which is formed with nozzles 51 corresponding to the pressure chambers 52, are bonded to the surface of the pressure chambers 52 on the opposite side to the diaphragm 56. Adhesive bonding, or the like, is used to bond these plates together.

Figure 9K:
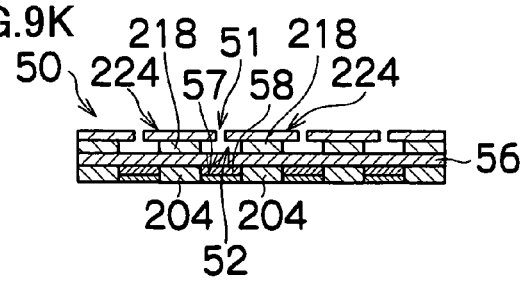

FIG. 9K illustrates an etching step. The unwanted portion of the base substrate 200 is removed by etching. More specifically, the base substrate 200 is a sacrificial layer which is at least partially removed. It is possible to leave the portion of the base substrate 200 which does not impede displacement of the diaphragm 56, when the diaphragm 56 is deformed by driving the piezoelectric bodies 58.

In the etching process, the portion of the base substrate 200 that is to be removed, and the portion that is not to be removed, are determined by a mask pattern. It is also possible to remove the base substrate 200 by means of machine processing.

Figure 14:
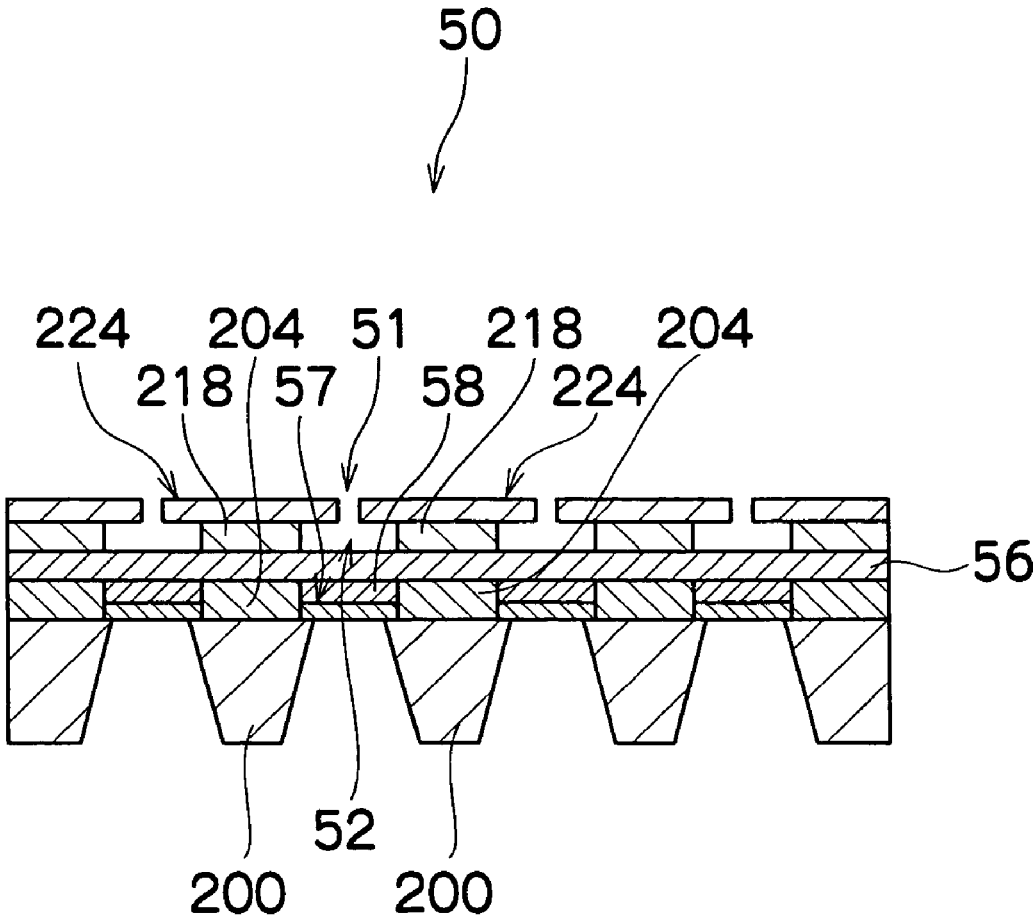
FIG. 14 is a cross-sectional diagram showing the three-dimensional structure of a print head relating to the present embodiment.

FIG. 14 shows a mode in which a portion of the base substrate 200 is left. As shown in FIG. 14, the base substrate 200 is removed in the portions corresponding to the places where the individual electrodes 57 are formed, and the remainder of the base substrate 200 is left. By adopting this composition, it is possible to obtain a greater warp preventing effect in the print head 50 as a whole, without impeding the displacement of the diaphragm 56 due to driving of the piezoelectric bodies 58.

Figure 15:
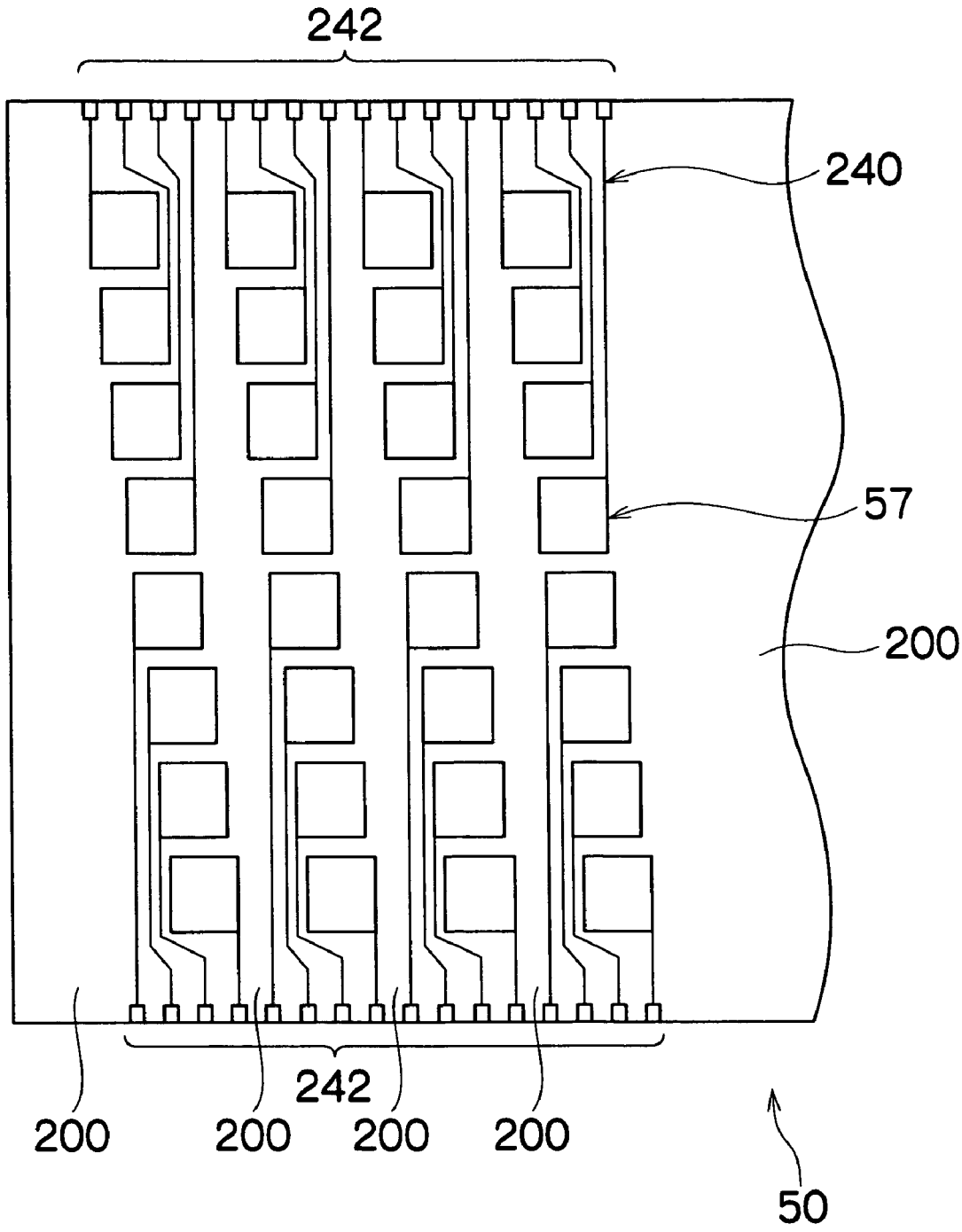
FIG. 15 is a perspective plan diagram of the print head shown in FIG. 14 as viewed from the side corresponding to the individual electrode forming surface.

FIG. 15 is a plan diagram showing an enlargement of a portion of the print head 50 as viewed from the side corresponding to the individual electrodes 57 (the under side in FIG. 14). FIGS. 3A to 3C show a mode where six nozzles are arranged in the breadthways direction of the print head, whereas FIG. 15 shows a mode where eight nozzles are arranged in the breadthways direction of the print head 50. Furthermore, FIGS. 3A to 3C show a perspective plan diagram as viewed from the side where the nozzles are formed, whereas FIG. 15 shows a perspective plan diagram viewed from the side where the individual electrodes are formed.

As shown in FIG. 15, the base substrate 200 is removed in the region where the individual electrodes 57, the wiring 240 to the individual electrodes, and the electrodes 242 for this wiring 240 are formed, and the base substrate 200 is left in the regions apart from this. In order to simplify the mask pattern, the base substrate 200 may be removed in the region where the individual electrodes 57 are formed, at the least. If the base substrate 200 is not removed in the part corresponding to the region where the pads (lead electrodes) 242 are formed, then it is necessary to provide a region for connecting the wiring to the individual electrodes 57. Therefore, desirably, the base substrate 200 is removed in the region where the pads 242 are formed.

Figure 16:
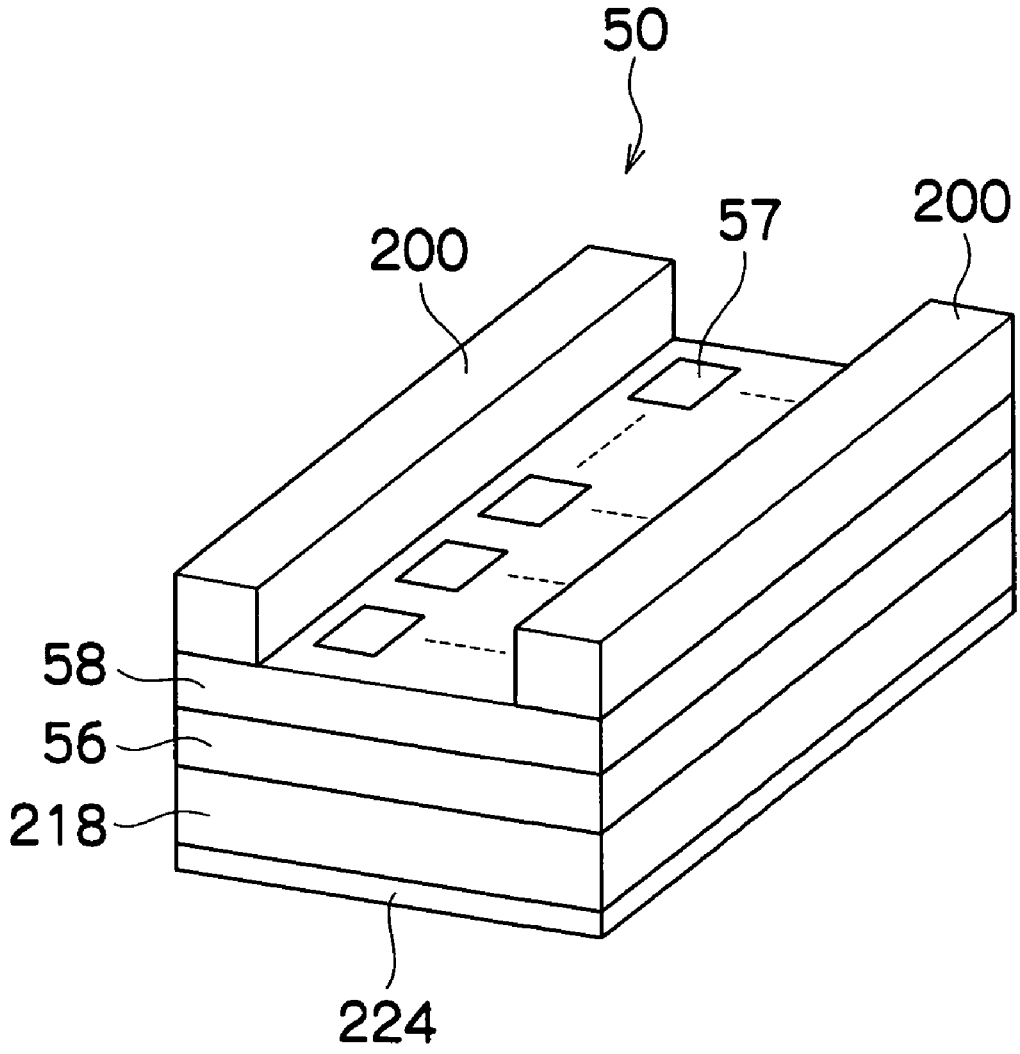
FIG. 16 is an oblique diagram showing a further mode of the print head illustrated in FIG. 15.

Moreover, it is also possible to leave portions of the base substrate 200 extending in the lengthwise direction of the print head 50 at either end of the head in the breadthways direction, as indicated by the oblique view of the print head 50 shown in FIG. 16 (which provides a view of FIG. 14 from the under side).

In the mode illustrated in FIG. 16, the mask pattern for removing the base substrate 200 is simplified, and the step of removing the base substrate 200 can also be simplified. Therefore, a significant effect is obtained in terms of reducing the warping of the print head 50 in the lengthwise direction.

FIGS. 17A to 17L show a mode where stainless steel (SUS430) is used for the base substrate 200. The coefficient of thermal expansion, a, of the SUS 430 used in the base substrate 200 is $10.5\times10^{-6}/°$ C., and the coefficient of thermal expansion, b, of the PZT used in the piezoelectric body 58 is $10.4\times10^{-6}/°$ C. Therefore the ratio b/a expressed by (Formula 5) is 0.99.

Figure 17A:
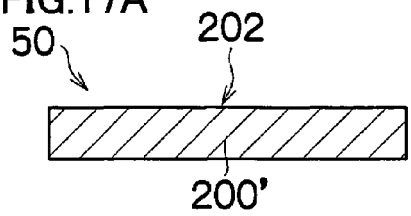
FIGS. 17A to 17L are diagrams showing manufacturing steps in a case where SUS430 is used as the substrate of the print head relating to the present embodiment.

In this example, a suitable material having a coefficient of thermal expansion, a, near the coefficient of thermal expansion, b, of the piezoelectric body 58 is used for the base substrate 200. In FIGS. 17A to al 7C, items which are the same as or similar to those in FIGS. 9A to 9K are labeled with the same reference numerals and description thereof is omitted here.

Figure 17B:
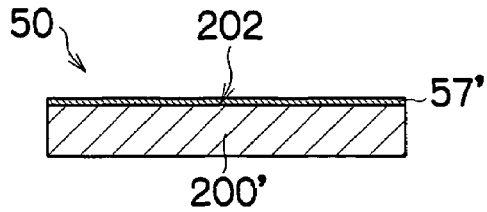

FIG. 17A shows a SUS 430 base substrate 200' and FIG. 17B shows an individual electrode layer forming step in which an individual electrode layer 57' containing at least an individual electrode 57 formed by a thin film of metal, such as gold (Au), copper (Cu), platinum (Pt), or the like, or a metallic oxide, such as titanium oxide ($TiO_2$), is formed on the piezoelectric body forming surface 202 of the base substrate 200'.

The aerosol deposition method is suitable for use in the individual electrode layer forming step shown in FIG. 17B, but it may also be form as a film by plating, sputtering, vapor deposition, or the like.

Figure 17C:
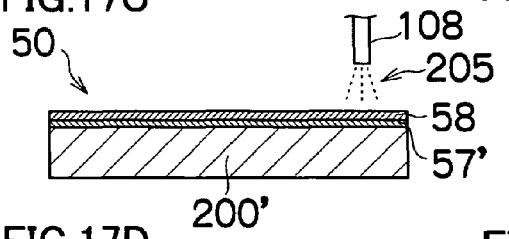

As shown in FIG. 17C, a piezoelectric body 58 is then formed on the surface of the individual electrode layer 57' formed by the individual electrode forming step shown in FIG. 17B, on the side opposite to the base substrate 200', and heat treatment is performed in order to sinter the piezoelectric body 58.

A piezoelectric ceramic, such as $Pb(Zr, Ti)O_3$, is used as the material for the piezoelectric body 58, and the aerosol deposition method as illustrated in FIG. 8 is suitable as a technique for the piezoelectric body forming step shown in FIG. 17C. More specifically, in the piezoelectric body forming step, micro-particles of piezoelectric material 205 sprayed from a nozzle 108 are deposited onto the individual electrode layer 57', thereby forming a piezoelectric body 58.

Figure 17D:
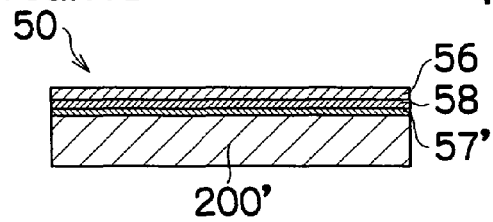

Furthermore, a diaphragm 56 is formed on the piezoelectric body 58 formed by the piezoelectric body forming step and heat treatment step shown in FIG. 17C, on the opposite side to the individual electrode layer 57'. FIG. 17D shows a step for forming a diaphragm. In this diaphragm forming step, a metal thin film is used, in such a manner that the diaphragm 56 can also serve as a common electrode.

The aerosol deposition method may be used as a technique for the diaphragm forming step, but it is also possible to bond a diaphragm 56 formed previously to a prescribed size and shape, by means of an adhesive, or the like.

In FIGS. 17A to 17L, the grinding step illustrated in FIG. 9E is omitted, but desirably, a grinding step is included in order to grind the diaphragm forming surface of the piezoelectric body 58, between the heat treatment step and the diaphragm forming step.

Figure 17E:
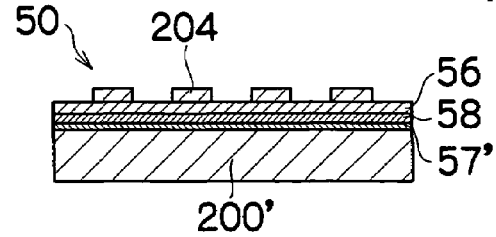

When a diaphragm 56 has been formed by the diaphragm forming step shown in FIG. 17D, a masking step is carried out, as illustrated in FIG. 17E. In this masking step, masking is carried out using a resist pattern in the region of the diaphragm 56 where pressure chambers 52 are to be formed, on the surface opposite to the piezoelectric body 58.

Figure 17F:
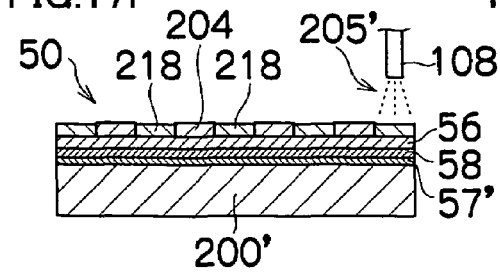

After the masking step shown in FIG. 17E, a pressure chamber forming step is carried out as illustrated in FIG. 17F. The material of the pressure chamber walls 218 may be a metal material, such as Ni, or Cu, or it may be a metal material, ceramic, silicon, or the like. The aerosol deposition method is used for the pressure chamber forming step illustrated in FIG. 17F. Micro-particles of metal (or micro-particles of metal oxide, ceramic material or silicon) 205' sprayed from a nozzle 108 are deposited onto the region where the pressure chamber walls 218 are to be formed, thereby creating the pressure chamber walls 218.

Figure 17G:
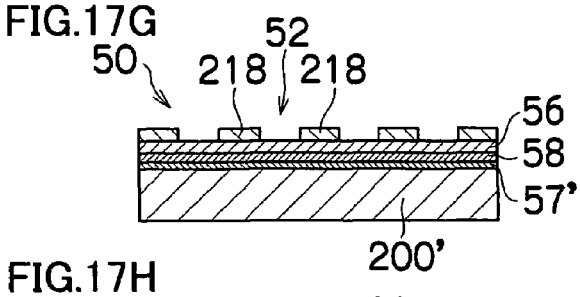

After the pressure chamber forming step shown in FIG. 17F, the resist pattern in the region where the pressure chambers 52 are to be formed is removed by a resist removing step illustrated in FIG. 17G.

Figure 17H:
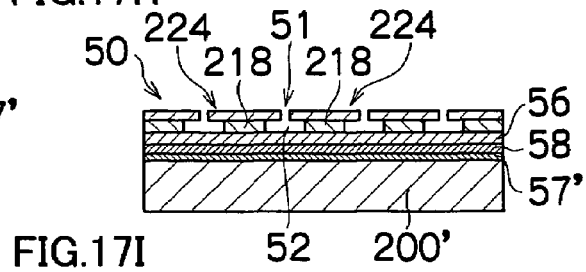

Furthermore, after the resist removing step shown in FIG. 17F, a nozzle plate 224 formed with nozzles 51 is bonded to the pressure chamber walls 218 by means of a plate bonding step as illustrated in FIG. 17H.

Figure 17I:
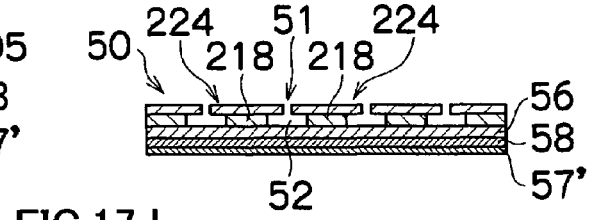

After the nozzle plate bonding step illustrated in FIG. 17H, the base substrate 200 is removed by a substrate removing step as illustrated in FIG. 17I. A masking step (individual electrode forming mask) is carried out as illustrated in FIG. 17J, in which the surface of the individual electrode layer 57' on the opposite side to the piezoelectric body 58 is masked with a resist pattern 260 in the regions where individual electrodes 57 are to be formed, in positions corresponding to the pressure chambers 52.

Figure 17J:
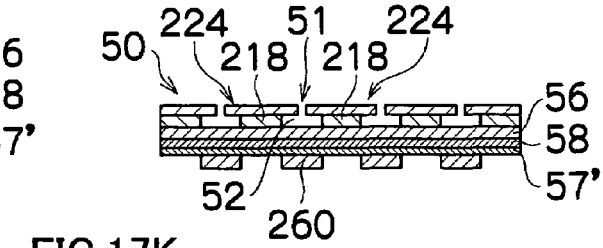
Figure 17K:
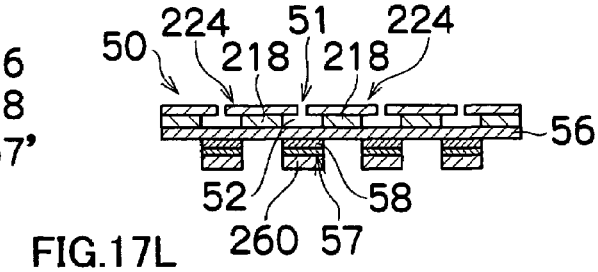

Individual element processing is performed to remove the individual electrode layer 57' and the piezoelectric body 58 while leaving the regions masked by the masking step shown in FIG. 17J. FIG. 17K shows an individual element processing step. In the individual element processing step, a technique such as reactive ion etching (RIE) or ion milling, is used.

Figure 17L:
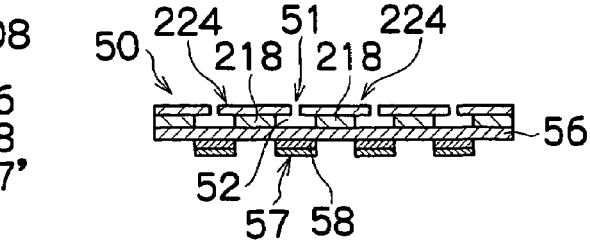

Furthermore, after removing the resist 260 by means of the resist removing step shown in FIG. 17L, wiring is formed to the individual electrodes 57, and the like.

In this way, a print head 50 is manufactured by means of the step in FIGS. 17A to 17L.

FIGS. 18A to 18I show manufacturing steps for a print head 50 comprising a split electrode type piezoelectric body. In FIGS. 18A to 18I, items which are the same as or similar to those in FIGS. 9A to 9K are labeled with the same reference numerals and description thereof is omitted here.

Figure 18A:
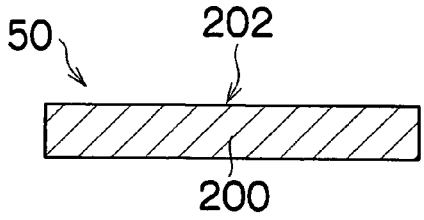
FIGS. 18A to 18I are diagrams showing manufacturing steps for print head having a split electrode type actuator, in a print head relating to the present embodiment.

FIG. 18A shows a base substrate 200. Similarly to the print head 50 having a split mechanism type piezoelectric body illustrated in FIGS. 9A to 9K, a material having a coefficient of thermal expansion near that of the piezoelectric body 58 is used for the base substrate 200.

Figure 18B:
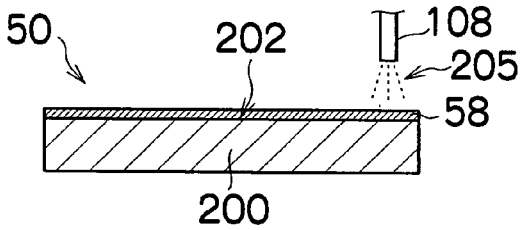

Firstly, as shown in FIG. 18B, a piezoelectric body 58 is formed on the piezoelectric body forming surface 202 of the base substrate 200. In a split electrode type piezoelectric body, a plurality of individual electrodes are provided on a single piezoelectric body, and independent drive voltages (drive signals) are applied to the individual electrodes, respectively. Therefore, the regions of the piezoelectric body where the individual electrodes are formed, which are applied with a drive voltage, generate a piezoelectric effect in accordance with the drive voltage applied to each particular individual electrode. In this way, one piezoelectric body is able to operate as a plurality of piezoelectric bodies. Consequently, when forming a split electrode type piezoelectric body, it is sufficient to form at least one piezoelectric body on the piezoelectric body forming surface of the base substrate 200.

More specifically, at least one piezoelectric body should be formed on the piezoelectric body forming surface 202 of the base substrate 200, in the region where the piezoelectric body is to be formed. Of course, it is also possible to divide the piezoelectric body forming region into a plurality of regions, in such a manner that a piezoelectric body is formed in each separate region.

A piezoelectric ceramic, such as $Pb(Zr, Ti)O_3$, is used as the material for the piezoelectric body 58, and the aerosol deposition method is suitable as a technique for the piezoelectric body forming step. As shown in FIG. 18B, micro-particles of piezoelectric material 205 sprayed from a nozzle 108 are deposited onto the piezoelectric body forming surface 202, thereby forming a piezoelectric body 58. Moreover, when the film of the piezoelectric body 58 has been formed, heat treatment is carried out and the piezoelectric body 58 is sintered.

Figure 18C:
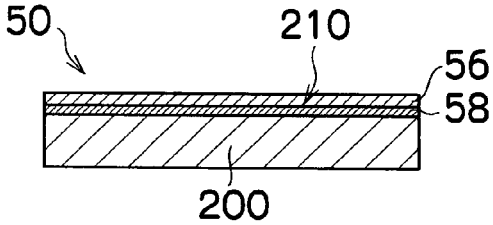

When a piezoelectric body 58 has been formed by the piezoelectric body forming step and the heat treatment step illustrated in FIG. 18B, a diaphragm 56 is formed on the diaphragm forming surface 210 of the piezoelectric body 58 by means of a diaphragm forming step as illustrated in FIG. 18C.

In the diaphragm forming step shown in FIG. 18C, the diaphragm 56 is made using a metal thin film, in such a manner that the diaphragm 56 can also serve as a common electrode. Furthermore, the aerosol deposition method may be used as a technique for the diaphragm forming step, but it is also possible to bond a diaphragm 56 formed previously to a prescribed size and shape, by means of an adhesive, or the like.

It is of course desirable that a grinding step as illustrated in FIG. 9E is carried out before the diaphragm forming step.

Figure 18D:
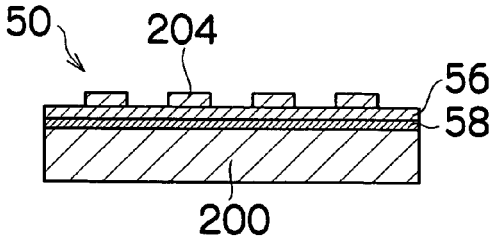

When a diaphragm 56 has been formed on the diaphragm forming surface 210 of the piezoelectric body 58 by means of the diaphragm forming step shown in FIG. 18C, a masking step is carried out as shown in FIG. 18D, and the region of the diaphragm 56 where the pressure chambers 52 are to be formed, on the side opposite to the piezoelectric body 58, is masked with a resist pattern 204.

Figure 18E:
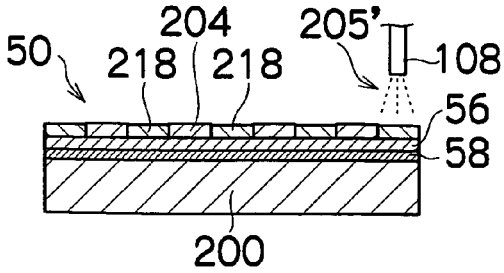

Thereupon, pressure chamber walls 218 are formed in the regions that have not been masked by the masking step shown in FIG. 18D. FIG. 18E shows a pressure chamber forming step for forming pressure chamber walls 218. The aerosol deposition method is used in the pressure chamber forming step illustrated in FIG. 18E. In other words, micro-particles of material (for example, micro-particles of metal) 205' sprayed from the nozzle 108 are deposited onto the region where the pressure chamber walls 218 are to be formed, thus creating pressure chamber walls 218.

Figure 18F:
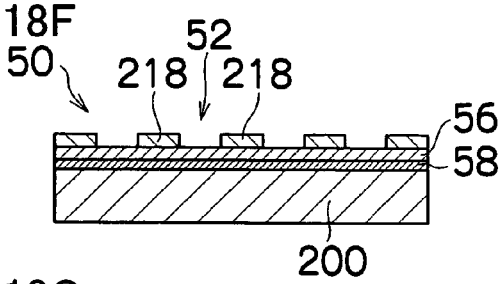
Figure 18G:
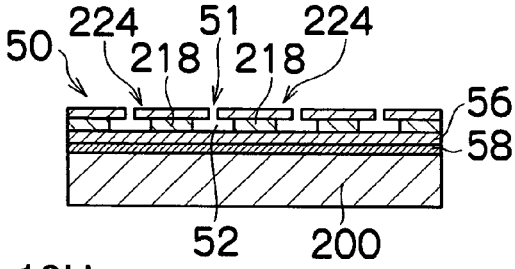

After removing the resist pattern 204 by means of a resist removing step as illustrated in FIG. 18F, the nozzle plate 224 and a flow channel plate (not illustrated) are bonded to the pressure chamber walls 218 by means of a nozzle plate bonding step as illustrated in FIG. 18G Moreover, in order to form individual electrodes 57 on the surface of the piezoelectric body 58 opposite to the pressure chambers 52 (the surface where the piezoelectric body 58 is bonded to the base substrate 200), it is necessary to remove at least a portion of the base substrate 200.

Figure 18H:
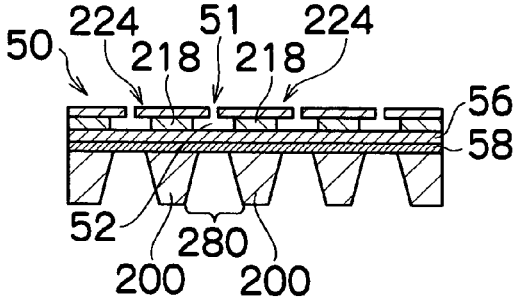

FIG. 18H shows an etching step for removing the region 280 of the base substrate 200 corresponding to the regions 280 where the individual electrodes 57 are formed, by means of etching. FIG. 18H shows a mode where a portion of the base substrate 200 is left, but it is of course possible to remove all of the base substrate 200. By adopting a composition in which a portion of the base substrate 200 is left, as illustrated in FIG. 18H, it is possible to increase the rigidity of the print head 50 by means of the remaining base substrate 200, and hence a beneficial effect in terms of preventing warping can be expected.

Figure 18I:
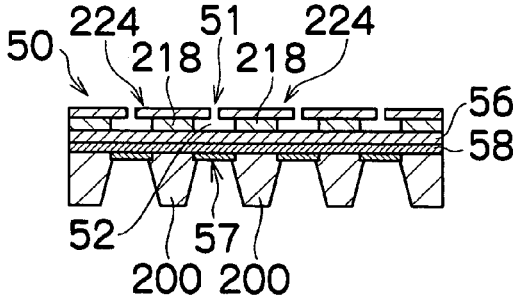

When the region of the base substrate 200 corresponding to the regions where the individual electrodes 57 are formed has been removed by the etching step shown in FIG. 18H, individual electrodes 57 are formed on the piezoelectric body 58, on the side opposite to the diaphragm, by means of an individual electrode forming step as illustrated in FIG. 18I.

The individual electrodes 57 may be formed by the aerosol deposition method in the individual electrode forming step illustrated in FIG. 18H, or they may be formed by another film forming technique, such as sputtering.

Furthermore, a metal, such as gold (Au), copper (Cu), platinum (Pt) or the like, or a metal oxide, such as titanium oxide ($TiO_2$), should be used to form the individual electrodes 57 and wiring.

In the present embodiment, a metal such as Ni or Cu is used as the material for the diaphragm 56 and the pressure chamber walls 218, but apart from metal materials, it is also possible to use a broad range of other materials, such as metal oxide, ceramic, or glass, which are compatible with the aerosol deposition method.

However, in a mode where the diaphragm 56 is to serve also as a common electrode, a material having electrical conductivity, such as a metal, is used for the diaphragm 56.

The print head 50 composed in the foregoing manner has a laminated structure in which films (layers) forming a piezoelectric body 58, a diaphragm 56, pressure chamber walls 218, and the like, are layered together, and since the film of the piezoelectric body 58 is formed on a base substrate 200 having a coefficient of thermal expansion near that of the piezoelectric body 58, the base substrate 200 and the piezoelectric body 58 being subjected to heat treatment when they have been formed into a joint body, then it is possible to reduce warping occurring in the base substrate 200 and the piezoelectric body 58 when they return to normal temperature from the heat treatment temperature during sintering of the piezoelectric body 58. Furthermore, it is possible to obtain a warp reducing effect up to the step of forming the piezoelectric body 58, and it is also possible to reduce the warping caused by thermal expansion by omitting heat treatment in later stages, such as the diaphragm forming step.

Moreover, since the piezoelectric body 58, the diaphragm 56 and the pressure chambers 52 are formed successively onto a base substrate 200 by the aerosol deposition method, improved dimensional accuracy of the pressure chambers 52 can be expected, and the freedom of design of the shape of the pressure chambers 52 is increased.

A piezoelectric film, which is a film including a piezoelectric body 58, is formed by the aerosol deposition method onto a base substrate 200 on which individual electrodes 57 have been formed, and heat treatment is carried out in order to sinter the piezoelectric body 58. A diaphragm 56 is formed after the heat treatment step. After forming the diaphragm 56, it is possible to form a film having high pressure resistance in a shape that permits ready handling, by performing sandblasting, using the individual electrodes 57 as stoppers.

In the present embodiment, a print head used in an inkjet recording apparatus was described as an example of a liquid droplet discharge head, but the present invention may also be applied to a discharge head used in a liquid discharge apparatus which forms images, or shapes, such as circuit wiring or machining patterns, by discharging a liquid (such as water, a chemical solution, resist, or processing liquid) onto a discharge receiving medium, such as a wafer, glass substrate, epoxy substrate, or the like.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method for manufacturing a discharge head having a piezoelectric body which applies a discharge pressure to a droplet of liquid discharged onto a discharge receiving medium, the method comprising:

a piezoelectric film forming step of forming a film of a piezoelectric body onto at least one surface of a base substrate, by means of a thin film forming technique;

a heat treatment step of sintering the piezoelectric film by heat treatment, at least one of during formation of the piezoelectric film in the piezoelectric film forming step, and after formation of the piezoelectric film;

a diaphragm forming step of forming a diaphragm by at least one of bonding and film deposition onto a surface of the piezoelectric body on an opposite side to the base substrate, after the piezoelectric body has been formed by the piezoelectric film forming step and the heat treatment step;

a pressure chamber forming step of forming pressure chamber walls on a surface of the diaphragm on an opposite side to the piezoelectric body;

a discharge hole plate bonding step of bonding a discharge hole plate formed with discharge holes which discharge the liquid held in pressure chambers, onto the pressure chamber walls; and a base substrate removing step of removing at least a portion of the base substrate, wherein a ratio b/a between a coefficient of thermal expansion, a, of the base substrate and a coefficient of thermal expansion, b, of the piezoelectric body is within a prescribed range, to prevent warping of the base substrate during the heat treatment step.

2. The method as defined in claim 1, wherein the ratio b/a between the coefficient of thermal expansion, a, of the base substrate and the coefficient of thermal expansion, b, of the piezoelectric body satisfies the following relationship:

$$0.6 \leqq (b/a) \leqq 1.4.$$

3. The method as defined in claim 1, wherein temperature T of the heat treatment step satisfies the following relationship:

$$T=(c/|a-b|)+Tc,$$

where Tc represents room temperature, a represents the coefficient of thermal expansion of the base substrate, b represents the coefficient of thermal expansion of the piezoelectric body, and c represents a difference in thermal change.

4. The method as defined in claim 3, wherein the difference in thermal change, c, satisfies the following relationship:

$$c \leqq 5.0 \times 10^{-3}.$$

5. The method as defined in claim 1, wherein at least the piezoelectric film is formed by means of an aerosol deposition method.

6. The method as defined in claim 1, wherein at least one of the diaphragm and the pressure chamber walls is formed by means of an aerosol deposition method.

7. A method for manufacturing a discharge head having a piezoelectric body which applies a discharge pressure to a droplet of liquid discharged onto a discharge receiving medium, the method comprising:

a piezoelectric film forming step of forming a film of a piezoelectric body onto at least one surface of a base substrate, by means of a thin film forming technique;

a heat treatment step of sintering the piezoelectric film by heat treatment, at least one of during formation of the piezoelectric film in the piezoelectric film forming step, and after formation of the piezoelectric film;

a diaphragm forming step of forming a diaphragm by at least one of bonding and film deposition onto a surface of the piezoelectric body on an opposite side to the base substrate, after the piezoelectric body has been formed by the piezoelectric film forming step and the heat treatment step;

a pressure chamber forming step of forming pressure chamber walls on a surface of the diaphragm on an opposite side to the piezoelectric body;

a discharge hole plate bonding step of bonding a discharge hole plate formed with discharge holes which discharge the liquid held in pressure chambers, onto the pressure chamber walls; and a base substrate removing step of removing at least a portion of the base substrate, wherein temperature T of the heat treatment step satisfies the following relationship:

$$T=(c/|a-b|)+Tc,$$

where Tc represents room temperature, a represents a coefficient of thermal expansion of the base substrate, b represents a coefficient of thermal expansion of the piezoelectric body, and c represents a difference in thermal change.

8. The method as defined in claim 7, wherein the difference in thermal change, c, satisfies the following relationship:

$$c \leqq 5.0\times10^{-3}.$$

9. The method as defined in claim 7, wherein at least the piezoelectric film is formed by means of an aerosol deposition method.

10. The method as defined in claim 7, wherein at least one of the diaphragm and the pressure chamber walls is formed by means of an aerosol deposition method.

11. A discharge head, comprising:

a base substrate;

a piezoelectric body formed by a thin film forming technique on at least one surface of the base substrate, the piezoelectric body applying a discharge pressure to a droplet of liquid discharged onto a discharge receiving medium;

a diaphragm formed by at least one of bonding and film deposition on a surface of the piezoelectric body on an opposite side to the base substrate;

pressure chamber walls formed on a surface of the diaphragm on an opposite side to the piezoelectric body; and a discharge hole plate provided with a discharge hole from which the droplet of the liquid is discharged and bonded to the pressure chamber walls on an opposite side to the diaphragm, wherein a ratio b/a between a coefficient of thermal expansion, a, of the base substrate and a coefficient of thermal expansion, b, of the piezoelectric body is within a prescribed range, to prevent warping of the base substrate during the heat treatment step.

12. The discharge head as defined in claim 11, wherein the ratio b/a between the coefficient of thermal expansion, a, of the base substrate and the coefficient of thermal expansion, b, of the piezoelectric body satisfies the following relationship:

$$0.6 \leqq (b/a) \leqq 1.4.$$

13. The discharge head as defined in claim 11, wherein the base substrate includes at least one of a stainless steel, crystallized glass, and Fe—Ni alloy.

14. The discharge head as defined in claim 11, wherein the base substrate is made from same material as the piezoelectric body.

15. The discharge head as defined in claim 11, wherein at least a portion of the base substrate has been removed.

16. A method for manufacturing a discharge head having a piezoelectric body which applies a discharge pressure to a droplet of liquid discharged onto a discharge receiving medium, the method comprising:

a piezoelectric film forming step of forming a film of a piezoelectric body onto at least one surface of a base substrate, by means of a thin film forming technique;

a heat treatment step of sintering the piezoelectric film by heat treatment, at least one of during formation of the piezoelectric film in the piezoelectric film forming step, and after formation of the piezoelectric film;

a diaphragm forming step of forming a diaphragm by at least one of bonding and film deposition onto a surface of the piezoelectric body on an opposite side to the base substrate, after the piezoelectric body has been formed by the piezoelectric film forming step and the heat treatment step;

a pressure chamber forming step of forming pressure chamber walls on a surface of the diaphragm on an opposite side to the piezoelectric body;

a discharge hole plate bonding step of bonding a discharge hole plate formed with discharge holes which discharge the liquid held in pressure chambers, onto the pressure chamber walls; and a base substrate removing step of removing at least a portion of the base substrate, wherein a ratio b/a between a coefficient of thermal expansion, a, of the base substrate and a coefficient of thermal expansion, b, of the piezoelectric body is within a prescribed range, an individual electrode forming step of forming individual electrode on a surface of the piezoelectric body opposite to the diaphragm after removing a portion of the base substrate corresponding to the individual electrode.

17. A method for manufacturing a discharge head having a piezoelectric body which applies a discharge pressure to a droplet of liquid discharged onto a discharge receiving medium, the method comprising:

a piezoelectric film forming step of forming a film of a piezoelectric body onto at least one surface of a base substrate, by means of a thin film forming technique;

a heat treatment step of sintering the piezoelectric film by heat treatment, at least one of during formation of the piezoelectric film in the piezoelectric film forming step, and after formation of the piezoelectric film;

a diaphragm forming step of forming a diaphragm by at least one of bonding and film deposition onto a surface of the piezoelectric body on an opposite side to the base substrate, after the piezoelectric body has been formed by the piezoelectric film forming step and the heat treatment step;

a pressure chamber forming step of forming pressure chamber walls on a surface of the diaphragm on an opposite side to the piezoelectric body;

a discharge hole plate bonding step of bonding a discharge hole plate formed with discharge holes which discharge the liquid held in pressure chambers, onto the pressure chamber walls; and a base substrate removing step of removing at least a portion of the base substrate, wherein a ratio b/a between a coefficient of thermal expansion, a, of the base substrate and a coefficient of thermal expansion, b, of the piezoelectric body is within a prescribed range, an individual element processing step of removing an individual electrode layer and the piezoelectric body while leaving a masked region of the individual electrode layer and the piezoelectric body, after removing the base substrate.

* * * * *